US010525728B2

(12) United States Patent
Hayashi

(10) Patent No.: US 10,525,728 B2
(45) Date of Patent: Jan. 7, 2020

(54) PRINTING APPARATUS AND PRINTING METHOD

(71) Applicant: SEIKO EPSON CORPORATION, Tokyo (JP)

(72) Inventor: Takuma Hayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/903,213

(22) Filed: Feb. 23, 2018

(65) Prior Publication Data

US 2018/0264841 A1 Sep. 20, 2018

(30) Foreign Application Priority Data

Mar. 16, 2017 (JP) ..... 2017-050916

(51) Int. Cl.

| | |
|---|---|
| ***B41J 2/21*** | (2006.01) |
| ***B41J 2/155*** | (2006.01) |
| ***B41J 2/045*** | (2006.01) |
| ***B41J 2/14*** | (2006.01) |
| ***B41J 2/205*** | (2006.01) |

(52) U.S. Cl.

CPC ..... *B41J 2/2146* (2013.01); *B41J 2/0458* (2013.01); *B41J 2/04581* (2013.01); *B41J 2/1433* (2013.01); *B41J 2/155* (2013.01); *B41J 2/2054* (2013.01); *B41J 2/2103* (2013.01)

(58) Field of Classification Search

CPC ..... H05K 3/321; H05K 3/361

See application file for complete search history.

(56) References Cited

U.S. PATENT DOCUMENTS

| | | | |
|---|---|---|---|
| 6,328,418 | B1 | 12/2001 | Yamada et al. |
| 2005/0128229 | A1 | 6/2005 | Shibata et al. |
| 2009/0015611 | A1 | 1/2009 | Ochiai et al. |
| 2015/0130875 | A1* | 5/2015 | Tamenaga et al. .... B41J 2/1433 |

(Continued)

FOREIGN PATENT DOCUMENTS

| | | | |
|---|---|---|---|
| JP | 2001-058422 | A | 3/2001 |
| JP | 2005-177991 | A | 7/2005 |

(Continued)

*Primary Examiner* — Juanita D Jackson

(74) *Attorney, Agent, or Firm* — Global IP Counselors, LLP

(57) ABSTRACT

A recording head has two or more first nozzle rows from which an ink droplet of a first color is discharged, two or more second nozzle rows from which an ink droplet of a second color is discharged, and two or more third nozzle rows from which an ink droplet of a third color is discharged. In a plurality of nozzle rows from which an ink droplet is discharged on the same line along the relative movement direction, a distance between the first nozzle row and the second nozzle row in the relative movement direction is fixed, and a plurality of distances are present regarding a distance between the first nozzle row and the third nozzle row in the relative movement direction. Concerning an amount-of-ink upper limit that is an upper limit of an amount of ink that is dischargeable per unit area of the print substrate, first printing in which an amount-of-ink upper limit for a combination of the first nozzle row and the third nozzle row is smaller than an amount-of-ink upper limit for a combination of the first nozzle row and the second nozzle row is performed.

11 Claims, 10 Drawing Sheets

| INK COLOR COMBINATION | INTER-COLOR DISTANCE | AMOUNT-OF-INK UPPER LIMIT | |
|---|---|---|---|
| | | LUT1 | LUT2 |
| C+M (B) | FIXED | Db=150% | Db=150% |
| C+Y (G) | DIFFERENT | Dg=120% | Dg=150% |
| M+Y (R) | DIFFERENT | Dr=120% | Dr=150% |

Db=MAX(Cj+Mj)

Dg=MAX(Cj+Yj)

Dr=MAX(Mj+Yj)

(56) References Cited

U.S. PATENT DOCUMENTS

| | | | | |
|---|---|---|---|---|
| 2015/0197090 | A1 | 7/2015 | Akahane | |
| 2016/0136958 | A1 | 5/2016 | Akahane | |
| 2017/0157937 | A1* | 6/2017 | Imanura et al. | B41J 2/175 |
| 2017/0291417 | A1* | 10/2017 | Okubo et al. | B41J 2/1433 |

FOREIGN PATENT DOCUMENTS

| | | | |
|---|---|---|---|
| JP | 2009-012390 | A | 1/2009 |
| JP | 2015-131447 | A | 7/2015 |

* cited by examiner

FIG. 5

| INK COLOR COMBINATION | INTER-COLOR DISTANCE | AMOUNT-OF-INK UPPER LIMIT | |
|---|---|---|---|
| | | LUT1 | LUT2 |
| C+M (B) | FIXED | Db=150% | Db=150% |
| C+Y (G) | DIFFERENT | Dg=120% | Dg=150% |
| M+Y (R) | DIFFERENT | Dr=120% | Dr=150% |

$$Db=MAX(Cj+Mj)$$

$$Dg=MAX(Cj+Yj)$$

$$Dr=MAX(Mj+Yj)$$

PRINTING APPARATUS AND PRINTING METHOD

BACKGROUND

1. Technical Field

The present invention relates to a technology for a recording head that has a plurality of nozzle rows.

2. Related Art

An ink jet printer, for example, causes a plurality of nozzles, which are arranged side by side in a predetermined nozzle side-by-side arrangement direction, and a print substrate to move relative to each other in a relative movement direction that intersects the nozzle side-by-side arrangement direction, discharges an ink droplet from the nozzle according to recording data, and forms a dot on the print substrate. Furthermore, a line printer is also known that transports the print substrate without causing nozzles, which are arranged over almost an entire width direction that intersects a transportation direction of the print substrate, to be moved, and forms a printing image, in order to perform printing at high speed. In some cases, in order to arrange the nozzles over the entire width direction of the print substrate, a recording head that results from combining a plurality of head chips in nozzle rows is included.

For example, in a case where a plurality of head chips in which nozzle rows for cyanogen (C), magenta (M), and yellow (Y) are arranged side by side in a transportation direction are combined, at least two head chips need to be arranged side by side in the transportation direction in the recording head. When four nozzle rows are present in each head chip in the transportation direction, the recording head is long in the transportation direction, it is easy for irregularity to occur in a landing position of an ink droplet, and it is easy for the print substrate to come into contact with the head chip. For this reason, for example, it is considered that in each head chip, a nozzle row for C and a nozzle row for Y are arranged side by side in the nozzle side-by-side arrangement direction, a nozzle row for M and a nozzle for K are arranged side by side in the nozzle side-by-side arrangement direction, and two nozzle rows are arranged side by side in the transportation direction.

Moreover, in a head main body that is disclosed in JP-A-2015-131447, the nozzle row for C and the nozzle row for Y are arranged side by side in the nozzle side-by-side arrangement direction, and the nozzle row for M and the nozzle row for K are arranged side by side in the nozzle side-by-side arrangement direction.

In a case where in each head chip, a plurality of nozzle rows are arranged side by side in the nozzle side-by-side arrangement direction and the number of nozzle rows in the transportation direction is decreased, there are times when a distance between nozzle rows for different colors in the transportation direction differs with a position in the nozzle side-by-side arrangement direction, in a plurality of nozzle rows from which an ink droplet is discharged on the same line along the transportation direction. In this case, there are times when it is determined that a streak or color irregularity occurs along the transportation direction.

Moreover, the problem described above is also present in an apparatus other than the line printer, such as a serial printer.

SUMMARY

An advantage of some aspects of the invention is to provide a technology in which color irregularity due to the presence of a plurality of distances regarding a distance between nozzle rows for different colors in a relative movement direction of a recording head.

According to an aspect of the invention, there is provided a printing apparatus in which a recording head and a print substrate move relative to each other in a relative movement direction that is different from a side-by-side arrangement direction of nozzles in a nozzle row, in which the recording head has two or more first nozzle rows from which an ink droplet of a first color is discharged, two or more second nozzle rows from which an ink droplet of a second color is discharged, and two or more third nozzle rows from which an ink droplet of a third color is discharged, and in which, in a plurality of nozzle rows from which an ink droplet is discharged on the same line along the relative movement direction, a distance between the first nozzle row and the second nozzle row in the relative movement direction is fixed, and a plurality of distances are present regarding a distance between the first nozzle row and the third nozzle row in the relative movement direction, concerning an amount-of-ink upper limit that is an upper limit of an amount of ink that is dischargeable per unit area of the print substrate, first printing in which an amount-of-ink upper limit for a combination of the first nozzle row and the third nozzle row is smaller than an amount-of-ink upper limit for a combination of the first nozzle row and the second nozzle row is performed.

According to another aspect of the invention, there is provided a printing method in which a recording head and a print substrate move relative to each other in a relative movement direction that is different from a side-by-side arrangement direction of nozzles in a nozzle row, in which the recording head has two or more first nozzle rows from which an ink droplet of a first color is discharged, two or more second nozzle rows from which an ink droplet of a second color is discharged, and two or more third nozzle rows from which an ink droplet of a third color is discharged, and which in a plurality of nozzle rows from which an ink droplet is discharged on the same line along the relative movement direction, a distance between the first nozzle row and the second nozzle row in the relative movement direction is fixed, and a plurality of distances are present regarding a distance between the first nozzle row and the third nozzle row in the relative movement direction, concerning an amount-of-ink upper limit that is an upper limit of an amount of ink that is dischargeable per unit area of the print substrate, first printing in which an amount-of-ink upper limit for a combination of the first nozzle row and the third nozzle row is smaller than an amount-of-ink upper limit for a combination of the first nozzle row and the second nozzle row is performed.

In the configuration described above, a technology can be provided in which color irregularity due to the presence of a plurality of distances is possibly suppressed regarding a distance between nozzle rows for different colors in a relative movement direction of a recording head.

BRIEF DESCRIPTION OF THE DRAWINGS

The invention will be described with reference to the accompanying drawings, wherein like numbers reference like elements.

FIG. 5 is a diagram that schematically illustrates an example of an upper limit of an amount of ink of a secondary color.

DESCRIPTION OF EXEMPLARY EMBODIMENTS

Figure 1:
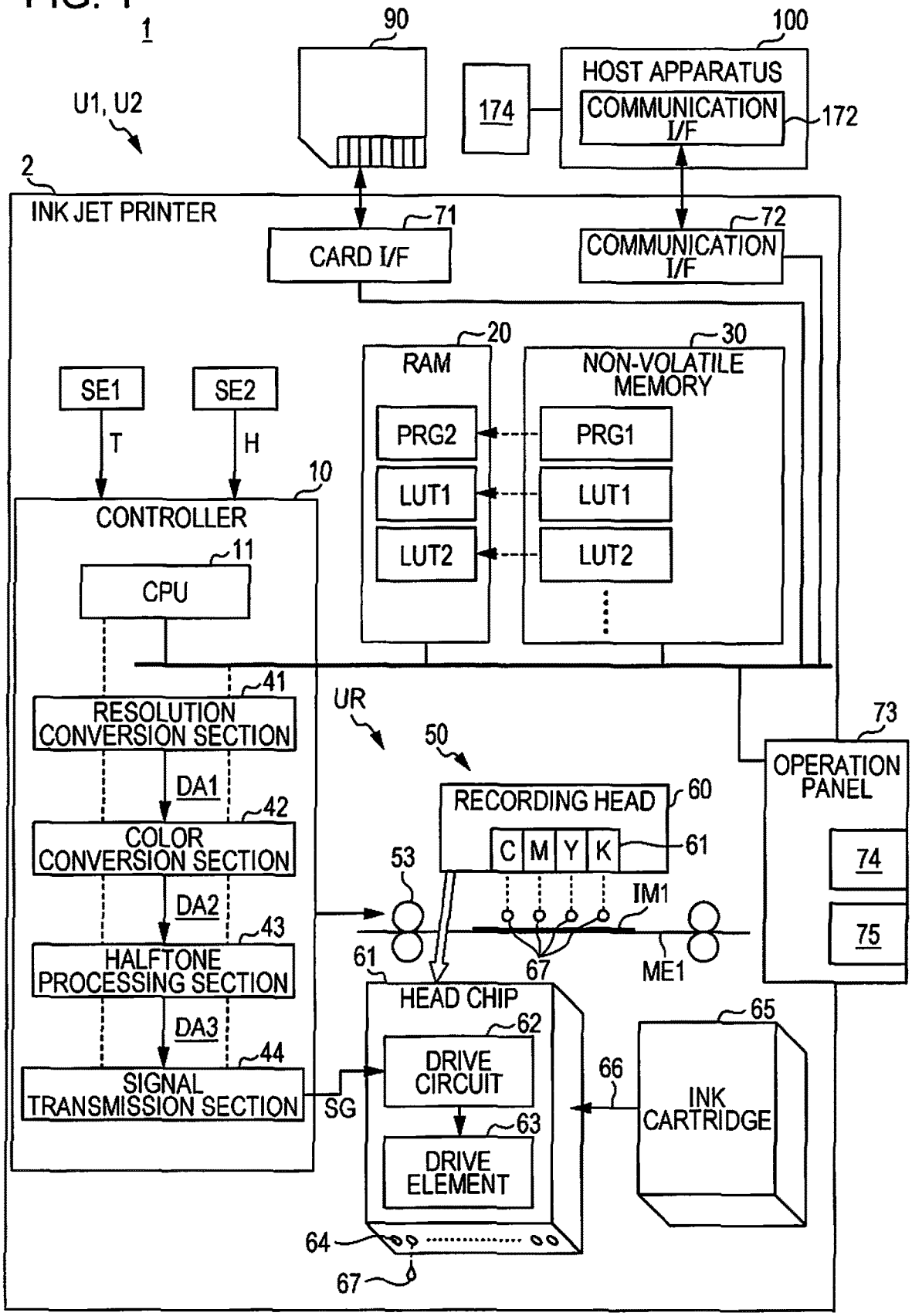
FIG. 1 is a diagram that schematically illustrates an example of a configuration of a printing apparatus.

Embodiments of the invention will be described below. Of course, the following embodiments only exemplify the invention, and all features that are described in the embodiments are not limited as being indispensable for solutions that are provided by the invention.

1. Outline of a Technology that is Included in the Invention

First, an outline of a technology that is included in the invention will be described with reference with examples that are illustrated in FIGS. 1 to 11B. Moreover, figures in the present application are figures that schematically illustrate examples. There is a difference in a magnification ratio in each direction that is illustrated in these figures. There are times when figures are inconsistent with each other. Of course, each element in the present technology is not limited to a specific example that is indicated by reference characters.

Aspect 1

A printing apparatus 1 according to an aspect of the present technology is the printing apparatus 1 in which a recording head 60 and a print substrate ME1 move relative to each other in a relative movement direction D2 that is different from a side-by-side arrangement direction D1 of nozzles 64 in a nozzle row 68. The recording head 60 has two or more first nozzle rows NL1, from each of which an ink droplet 67 of a first color (for example, C) is discharged, two or more second nozzle rows NL2, from each of which the ink droplet 67 of a second color (for example, M) is discharged, and two or more third nozzle rows NL3, from each of which the ink droplet 67 of a third color (for example, Y) is discharged. A distance (for example, L0) is fixed between the first nozzle row NL1 and the second nozzle row NL2 in the relative movement direction D2, in a plurality of nozzle rows 68 of rows, from each of which the ink droplet 67 is discharged on the same line DL along the relative movement direction D2, and as distances between the first nozzle row NL1 and the third nozzle row NL3 in the relative movement direction D2, there are present a plurality of distances (for example, L1 and L2). Concerning an amount-of-ink upper limit that is an upper limit for an amount of ink which is dischargeable per unit area of the print substrate ME1, the present printing apparatus 1 performs first printing in which an amount-of-ink upper limit (for example, Dg) for a combination of the first nozzle row NL1 and the third nozzle row NL3 is smaller than an amount-of-ink upper limit (for example, Db) for a combination of the first nozzle row NL1 and the second nozzle row NL2.

In a case where a distance between the first nozzle row NL1 and the third nozzle row NL3 is comparatively long on the same line DL along the relative movement direction D2, because a difference in the time taken to land the ink droplet 67 from each nozzle row 68 to the print substrate ME1 is comparatively great, it is easy for the ink droplet 67 that is landed in advance to dry. For this reason, it is difficult for the ink droplet 67 from each nozzle row 68 to be mixed, and it is difficult for the ink droplet 67 to flow out of each nozzle row 68. On the other hand, in a case where the distance between the first nozzle row NL1 and the third nozzle row NL3 is comparatively short on the same line DL along the relative movement direction D2, because the difference in the time taken to land the ink droplet 67 from each nozzle row 68 to the print substrate ME1 is comparatively small, it is difficult for the ink droplet 67 that is landed in advance to dry. For this reason, it is easy for the ink droplet 67 from each nozzle row 68 to be mixed, as is, in a liquid state, and it is easy for the ink droplet 67 to flow out of each nozzle row 68. When the ink droplet 67 from each nozzle row 68 is mixed, as is, in the liquid state, dot coloring due to an ink droplet is weakened when compared with a case where the distance between the first nozzle row NL1 and the third nozzle row NL3 is comparatively long.

Figure 10:
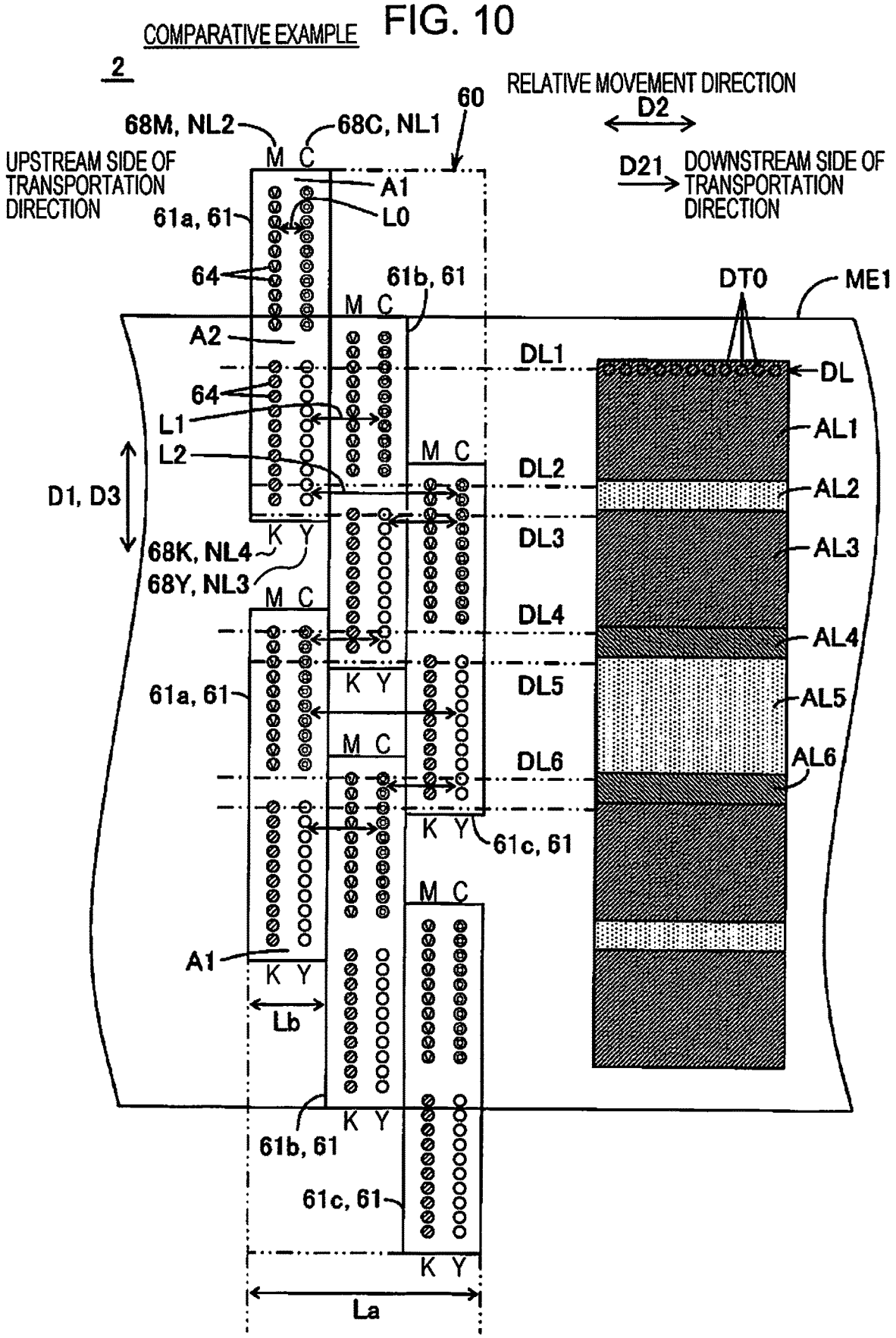
FIG. 10 is a diagram that schematically illustrates an example of color irregularity due to the presence of a plurality of distances regarding a distance between nozzle rows for different colors in a relative movement direction of a recording head in a comparative example.

FIG. 10 schematically illustrates an example of color irregularity due to the presence of a plurality of distances regarding a distance between nozzle rows for different colors in the relative movement direction D2 of the recording head 60 in a comparative example. In FIG. 10, the recording head 60 is illustrated when viewed from the side that is opposite to a nozzle surface of the nozzle 64. However, for convenience, a position of the nozzle 64 is indicated, and a nozzle from which to discharge an ink droplet of C, M, Y, or K is marked with a color of an ink droplet.

The recording head 60 that is illustrated in FIG. 10 has a plurality of head chips 61, each of which has a nozzle row 68C for C, a nozzle row 68M for M, a nozzle row 68Y for Y, and a nozzle row 68K for K. Here, the nozzle rows 68C and 68M are arranged side by side in the relative movement direction D2, the nozzle rows 68Y and 68K are arranged side by side in the relative movement direction D2, the nozzle rows 68C and 68Y are arranged side by side in the side-by-side arrangement direction D1, and the nozzle rows 68M and 68K are arranged side by side in the side-by-side arrangement direction D1. It is assumed that in order to realize high resolution of a printing image, a gap between each of the nozzles 64 in each nozzle row 68 needs to be small and on the other hand, an ink channel for each color needs to be formed and that because of this, non-discharge areas A1 and A2, nozzles for which are not present in the side-by-side arrangement direction D1 of the nozzle 64 in the head chip 61, occur. In this case, in order to arrange the nozzles 64 for CMYK (cyanogen, magenta, yellow, and black) on the same line DL, a minimum of three head chip 61 needs to be arranged side by side in the relative movement direction D2.

As illustrated in FIG. 10, a distance L0 between the nozzle rows 68C and 68M in the relative movement direction D2 is fixed. On the other hand, a plurality of distances, distances L1 and L2 are present regarding a distance between the nozzle rows 68C and 68Y in the relative movement direction D2, and a plurality of distances are present as well regarding a distance between the nozzle rows 68M and 68Y in the relative movement direction D2. For example, the distance between the nozzle rows 68C and 68Y in lines DL1 and DL3 is L1, and the distance between the nozzle rows 68C and 68Y in a line DL2 is L2 (L2>L1). Furthermore, the distance between the nozzle rows 68C and 68Y in lines DL4 and DL6 is L1, but the order of discharging the ink droplet is the reverse of that in the case of the lines DL1 and DL3 in this. The distance between the nozzle rows 68C and 68Y in a line DL5 is L2, but the order of discharging the ink droplet is the reverse of that in the case of the line DL2. Moreover, the lines DL1, DL2, DL3, DL4, DL5, and DL6 pass through printing areas AL1, AL2, AL3, AL4, AL5, and AL6, respectively, and the printing areas AL1, AL2, AL3, AL4, AL5, and AL6 are printing areas that have the same ink droplet discharge timing as the lines DL1, DL2, DL3, DL4, DL5, and DL6, respectively.

Figure 11A:
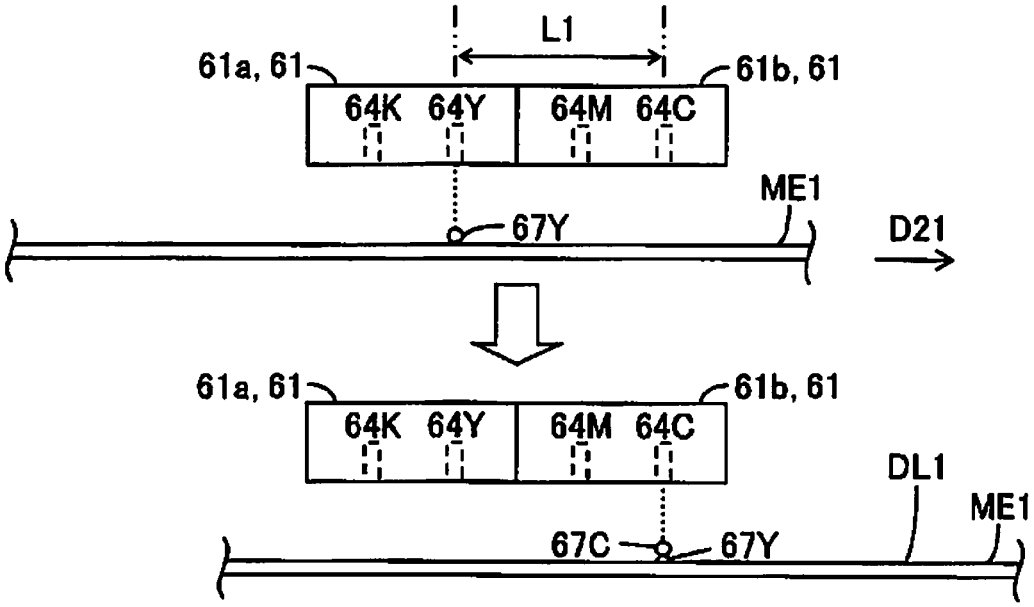
FIG. 11A is a diagram that schematically illustrates a state of an ink droplet that is discharged in a case where a distance between nozzle rows is comparatively short.

FIG. 11A schematically illustrates states of ink droplets 67C and 67Y that are discharged from nozzles 64C and 64Y of the nozzle rows 68C and 68Y, respective, in the line DL1 in which a distance between the nozzle rows is comparatively short. In FIG. 11A, first, the ink droplet 67Y is discharged from the nozzle 64Y for Y, and when the print substrate ME1 moves by as much as comparatively short distance L1 in a paper feeding direction D21, the ink droplet 67C is discharged from the nozzle 64C for C. In this case, when a portion of the preceding ink droplet 67Y is in the liquid state and the following ink droplet 67C in the liquid state overlaps the preceding ink droplet 67Y in the liquid state, the ink droplets 67C and 67Y are mixed, as are, in the liquid state, a blurred dot is formed, and thus coloring is weakened.

Figure 11B:
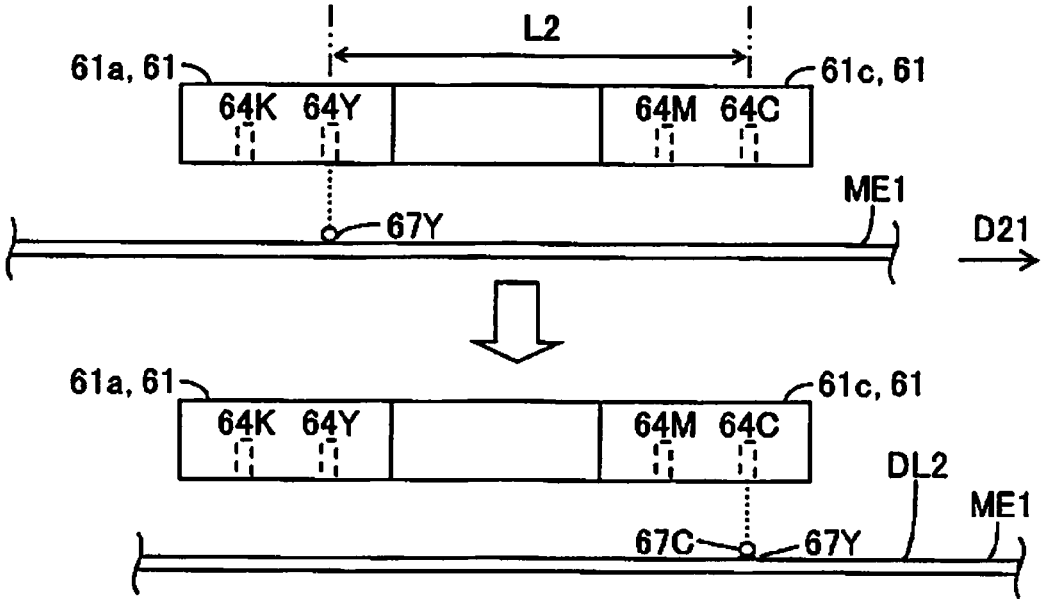
FIG. 11B is a diagram that schematically illustrates a state of an ink droplet that is discharged in a case where a distance between nozzle rows is comparatively long.

FIG. 11B schematically illustrates the states of ink droplets 67C and 67Y that are discharged from the nozzles 64C and 64Y, respectively, in the line DL2 in which the distance between the nozzle rows is comparatively long. In FIG. 11B, first, the ink droplet 67Y is discharged from the nozzle 64Y, and when the print substrate ME1 moves by as much as comparatively long distance L2 in the paper feeding direction D21, the ink droplet 67C is discharged from the nozzle 64C. In this case, although the preceding ink droplet 67Y dries and the following ink droplet 67C in the liquid state overlaps this portion, the ink droplets 67C and 67Y are not mixed and a dot that is to be formed is not blurred. Thus, the coloring is strengthened when compared with the line DL1.

As evident from the above, as illustrated in FIG. 10, among the printing areas AL1 to AL6 there are times when coloring is different in the adjacent printing areas and a streak or color irregularity along the relative movement direction D2 occurs in the printing image.

In Aspect 1 of the present technology, described above, in a case where the ink droplet 67 is discharged from the first nozzle row NL1 and the third nozzle row NL3 on the same line DL along the relative movement direction D2, the amount-of-ink upper limit Dg is lowered. Accordingly, a difference in coloring due to the distance between the first nozzle row NL1 and the third nozzle row NL3 in the relative movement direction D2 is suppressed and the color irregularity is suppressed. On the other hand, in a case where the ink droplet 67 is discharged from the first nozzle row NL1 and the second nozzle row NL2 on the same line DL in the relative movement direction D2, because the distance L0 between the first nozzle row NL1 and the second nozzle row NL2 is fixed, although the amount-of-ink upper limit Db is maintained, the color irregularity does not occur. When the amount-of-ink upper limit Db is lowered to such an extent, a color reproduction range as a whole is narrowed, but the amount-of-ink upper limit Db for a combination of the first nozzle row NL1 and the second nozzle row NL2 is maintained and thus color reproducibility is secured.

As described above, according to Aspect 1 described above, a printing apparatus can be provided that is capable of suppressing the color irregularity due to the presence of a plurality of distances regarding a distance between nozzle rows for different colors in the relative movement direction of the recording head.

The nozzle here is a small hole through which the ink droplet is ejected. The ink droplets include a droplet of color-free ink, such as an ink droplet that improves image quality, and the like. The relative movement between the recording head and the print substrate includes movement of the print substrate without the recording head moving, movement of the recording head without the print substrate, and movement of both of the recording head and the print substrate. Moreover, an additional description of Aspect 1 also holds true for the following aspects.

Aspect 2

Figure 2:
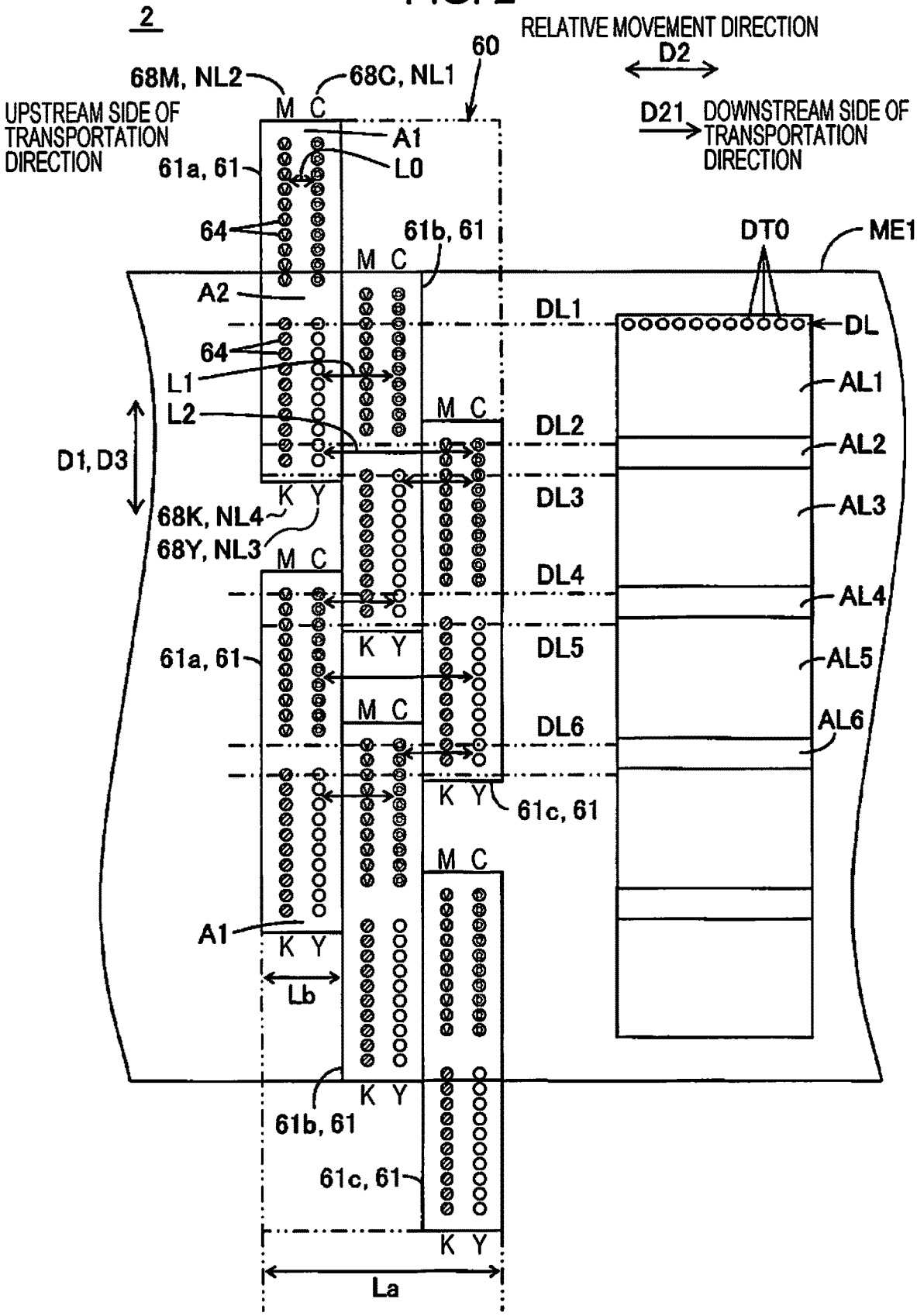
FIG. 2 is a diagram that schematically illustrates essential components of a line printer as an ink jet printer.

Aspect 2 is Illustrated in FIG. 2 and Other Figures

The recording head 60 may include a plurality of head chips 61, each of which has the first nozzle row NL1, the second nozzle row NL2, and the third nozzle row NL3. In the head chip 61, the first nozzle row NL1 and the second nozzle row NL2 may be arranged side by side in the relative movement direction D2, and one of the first nozzle row NL1 and the second nozzle row NL2 and the third nozzle row NL3 may be arranged side by side in the side-by-side arrangement direction D1. In the present aspect, because a length La of the recording head 60 in the relative movement direction D2 can be shortened, it is difficult for irregularity to occur in a landing position of the ink droplet 67, and it is difficult for the print substrate to come into contact with the head chip.

Aspect 3

Aspect 3 is Illustrated in FIG. 2 and Other Figures

In the head chip 61, the third nozzle row NL3 and a fourth nozzle row NL4 from which the ink droplet 67 of a fourth color (for example, K) is discharged may be arranged side by side in the relative movement direction D2. According to the aspect, an example can be provided in which the color irregularity due to the presence of a plurality of distances is possibly suppressed regarding the distance between the nozzle rows for different colors in the relative movement direction of the recording head.

Aspect 4

Aspect 4 is Illustrated in FIG. 2 and Other Figures

A length La of the recording head 60 in the relative movement direction D2 may be three times a length Lb of the head chip 61 in the relative movement direction D2. In the present aspect, because the length La of the recording head 60 in the relative movement direction D2 can be shortened, it is difficult for the irregularity to further occur in the landing position of the ink droplet 67, and it is difficult for the print substrate to further come into contact with the head chip.

Aspect 5

Aspect 5 is Illustrated in FIG. 2 and Other Figures

The first color, the second color, and the third color may be selected from among cyanogen, magenta, and yellow. According to the aspect, a suitable example can be provided in which the color irregularity due to the presence of a plurality of distances is suppressed regarding the distance between the nozzle rows for different colors in the relative movement direction of the recording head.

Aspect 6

Figure 7:
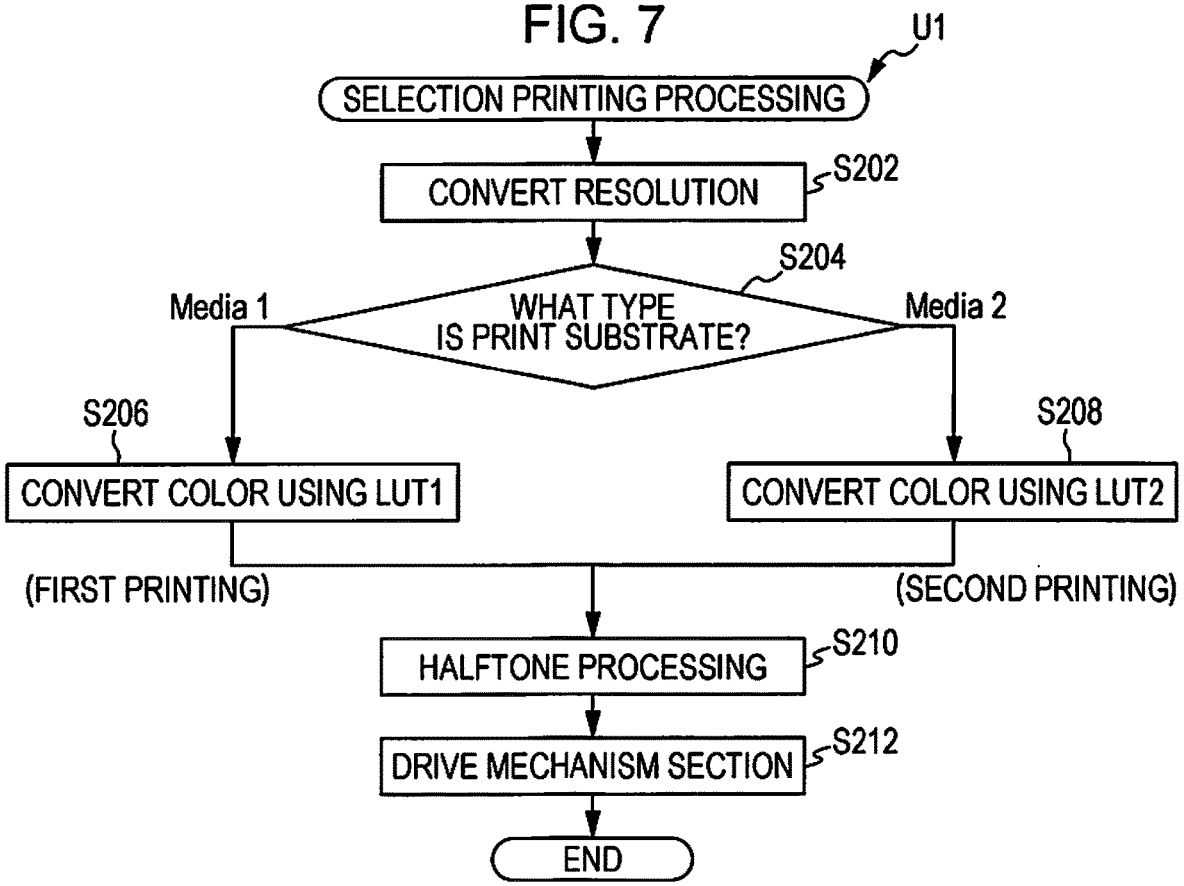
FIG. 7 is a flowchart illustrating an example of selection printing processing that uses the color conversion look-up table in accordance with a type of print substrate.

Aspect 6 is Illustrated in FIG. 7 and Other Figures

The present printing apparatus 1 may include a selection printing section U1 that selectively performs a plurality of printing operations including the first printing and second printing in which the amount-of-ink upper limit (for example, Dg) for the combination of the first nozzle row NL1 and the third nozzle row NL3 is set to be the amount-of-ink upper limit (for example, Db) for the combination of the first nozzle row NL1 and the second nozzle row NL2. According to the aspect, the selection that causes the color reproducibility to be improved is possible, a suitable example can be provided in which the color irregularity due to the presence of a plurality of distances is suppressed regarding the distance between the nozzle rows for different colors in the relative movement direction D2 of the recording head.

Moreover, although not included in Aspect 6 described above, the case where the printing apparatus does not perform the second printing is included in the present technology.

Aspect 7

Figure 6:
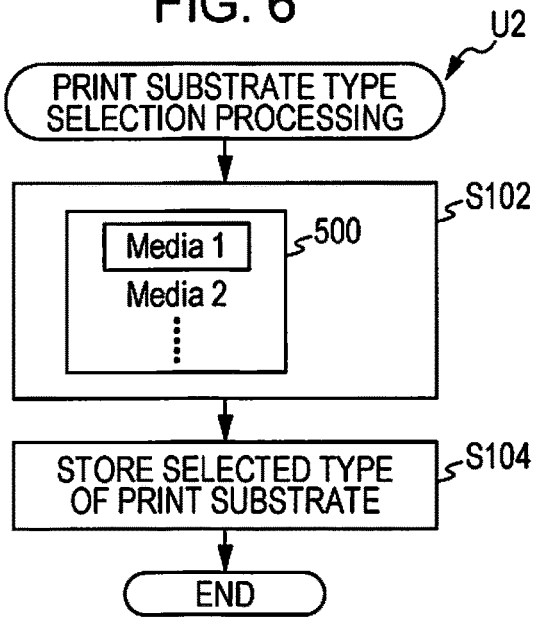
FIG. 6 is a flowchart illustrating an example of print substrate type selection processing.

Aspect 7 is Illustrated in FIG. 6

The present printing apparatus 1 may include a print substrate type selection section U2 through which a type of the print substrate ME1 that is used for printing is selected. In a case where the selected type of the print substrate ME1 is a first type, the selection printing section U1 may perform the first printing. In a case where the selected type of the print substrate ME1 is a second type, the selection printing section U1 may perform the second printing. According to the present aspect, in a case where the print substrate is the second type, the color reproducibility can be caused to be improved.

Aspect 8

Figure 8:
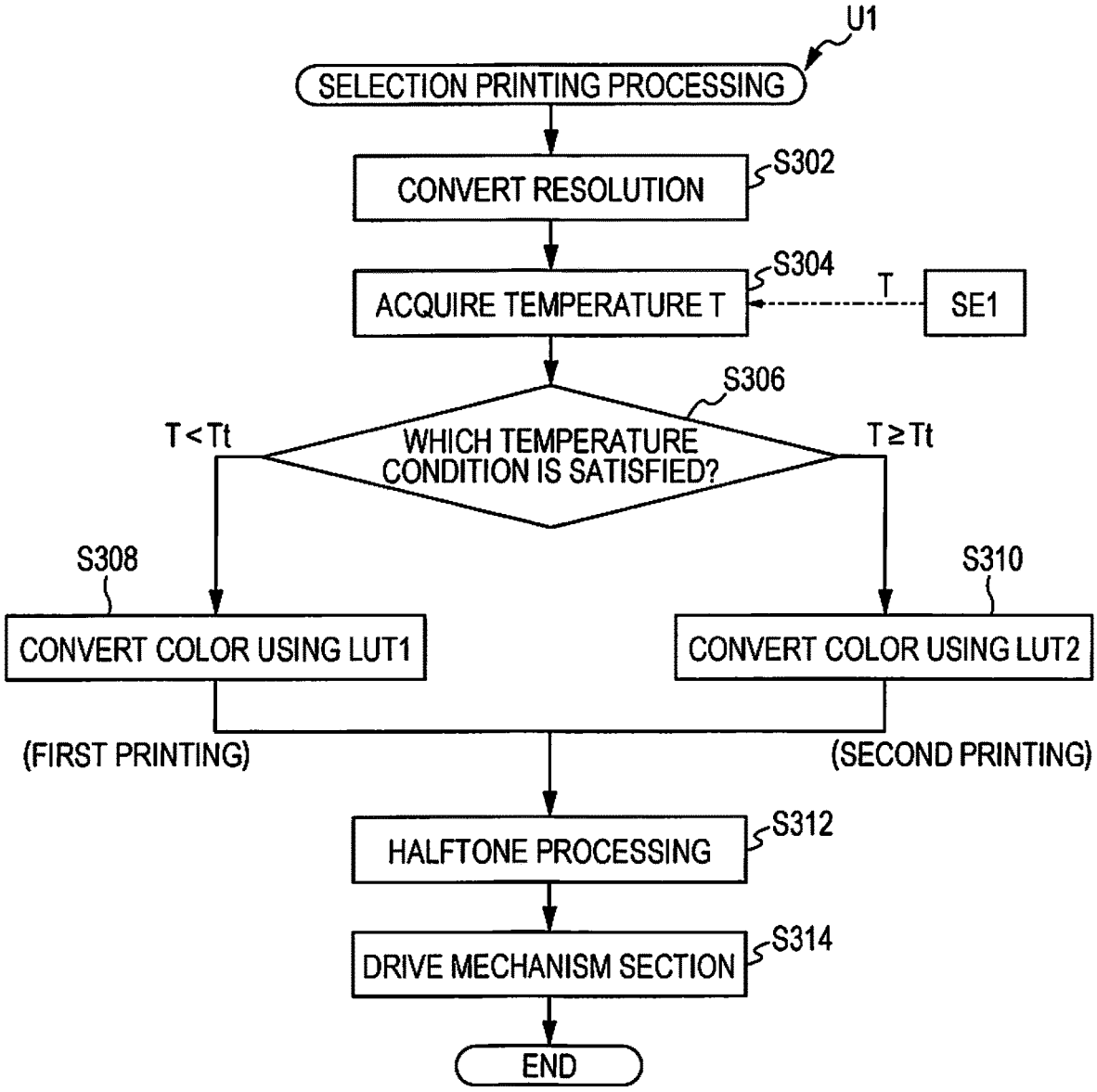
FIG. 8 is a flowchart illustrating an example of the selection printing processing that uses the color conversion look-up table in accordance with a temperature condition.

Aspect 8 is Illustrated in FIG. 8 and Other Figures

The present printing apparatus 1 may include a temperature sensor SE1 that measures a temperature T. In a case where the temperature T that is measured in the temperature sensor SE1 satisfies a first temperature condition (for example, in a case where the temperature T is lower than a temperature Tt), the selection printing section U1 may perform the first printing. In a case where the temperature T that is measured in the temperature sensor SE1 satisfies a second temperature condition (for example, in a case where the temperature T is equal to or higher than the temperature Tt) in which a temperature is higher than that in the first temperature condition, the selection printing section U1 may perform the second printing. According to the present aspect, in a case where the second temperature condition, a temperature in which is higher than that in the first temperature condition is satisfied, the color reproducibility can be caused to be improved.

Aspect 9

Figure 9:
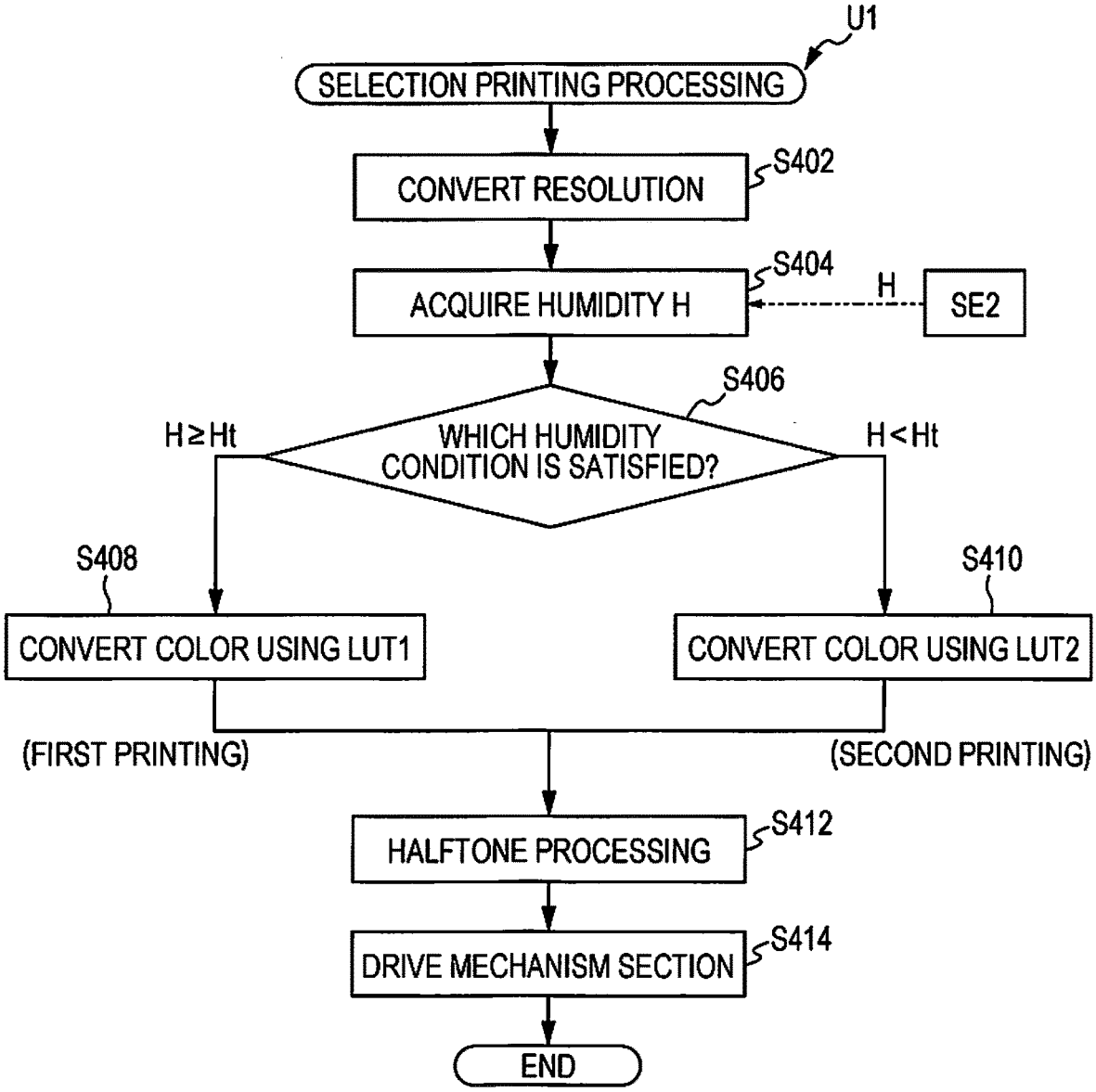
FIG. 9 is a flowchart illustrating an example of the selection printing processing that uses the color conversion look-up table in accordance with a humidity condition.

Aspect 9 is Illustrated in FIG. 9 and Other Figures

The present printing apparatus 1 may include the humidity sensor SE2 that measures humidity H. In a case where the humidity H that is measured in the humidity sensor SE2 satisfies a first humidity condition (for example, in a case where the humidity H is equal to or higher than humidity Ht), the selection printing section U1 may perform the first printing. In a case where the humidity H that is measured in the humidity sensor SE2 satisfies a second humidity condition (for example, in a case where the humidity H is lower than humidity Ht) in which humidity is lower than that in the first humidity condition, the selection printing section U1 may perform the second printing. According to the present aspect, in a case where the second humidity condition, humidity in which is lower than that in the first humidity condition is satisfied, the color reproducibility can be caused to be improved.

Aspect 10

Aspect 10 is Illustrated in FIGS. 7 to 9 and Other Figures

When performing the first printing, according to a first correspondence relationship (for example, a color conversion look-up table LUT1), the selection printing section U1 may convert an input color into an output color in which ink is used in such a manner that the amount-of-ink upper limit (for example, Dg) for the combination of the first nozzle row NL1 and the third nozzle row NL3 is smaller than the amount-of-ink upper limit (for example, Db) for the combination of the first nozzle row NL1 and the second nozzle row NL2. When performing the second printing, according to a second correspondence relationship (for example, a color conversion look-up table LUT2), the selection printing section U1 may convert the input color into the output color in which ink is used in such a manner that the amount-of-ink upper limit (for example, Dg) for the combination of the first nozzle row NL1 and the third nozzle row NL3 is the amount-of-ink upper limit (for example, Db) for the combination of the first nozzle row NL1 and the second nozzle row NL2. According to the present aspect, a suitable example can be provided in which the color irregularity due to the presence of a plurality of distances is suppressed regarding the distance between the nozzle rows for different colors in the relative movement direction of the recording head.

Aspect 11

Incidentally, a printing method according to an aspect of the present technology includes processes that correspond to the printing apparatus 1. According to the present aspect, a printing method can be provided in which the color irregularity due to the presence of a plurality of distances is possibly suppressed regarding the distance between the nozzle rows for different colors in the relative movement direction of the recording head.

Moreover, the present technology possibly finds application in a multi-function apparatus that includes the printing apparatus, a method of controlling the multi-function apparatus, a program for controlling the printing apparatus, a program for controlling the multi-function apparatus, and a computer-readable medium on which the program for controlling is recorded. The apparatus described above may be configured with a plurality of components that are distributed.

2. Specific Example of the Printing Apparatus that Includes an Image Processing Apparatus FIG. 1 schematically illustrates an example of a configuration of the printing apparatus including an image processing apparatus. The printing apparatus 1 that is illustrated in FIG. 1 is expressed as a printing system (a printing apparatus in a broad sense), and is assumed to at least include an ink jet printer 2 in a narrow sense, as a sale unit and to include a host apparatus 100 and the like. In FIG. 1, an example of a configuration of a line printer as an ink jet printer 2. The printing apparatuses in which the present technology possibly finds application may include a copy machine, a facsimile machine, a multi-function apparatus that has functions of the copy machine and the facsimile machine, and the like. Types of ink that are used in the ink jet printer which forms a color image include cyanogen (C) ink, magenta (M) ink, yellow (Y) ink, and black (K) ink. Of course, the types of ink may further include light cyanogen (Lc), light magenta (Lm), dark yellow (Dy), light black (Lk), red (R), orange (Or), green (Gr), color-free ink for improving image quality, and the like.

Figure 3:
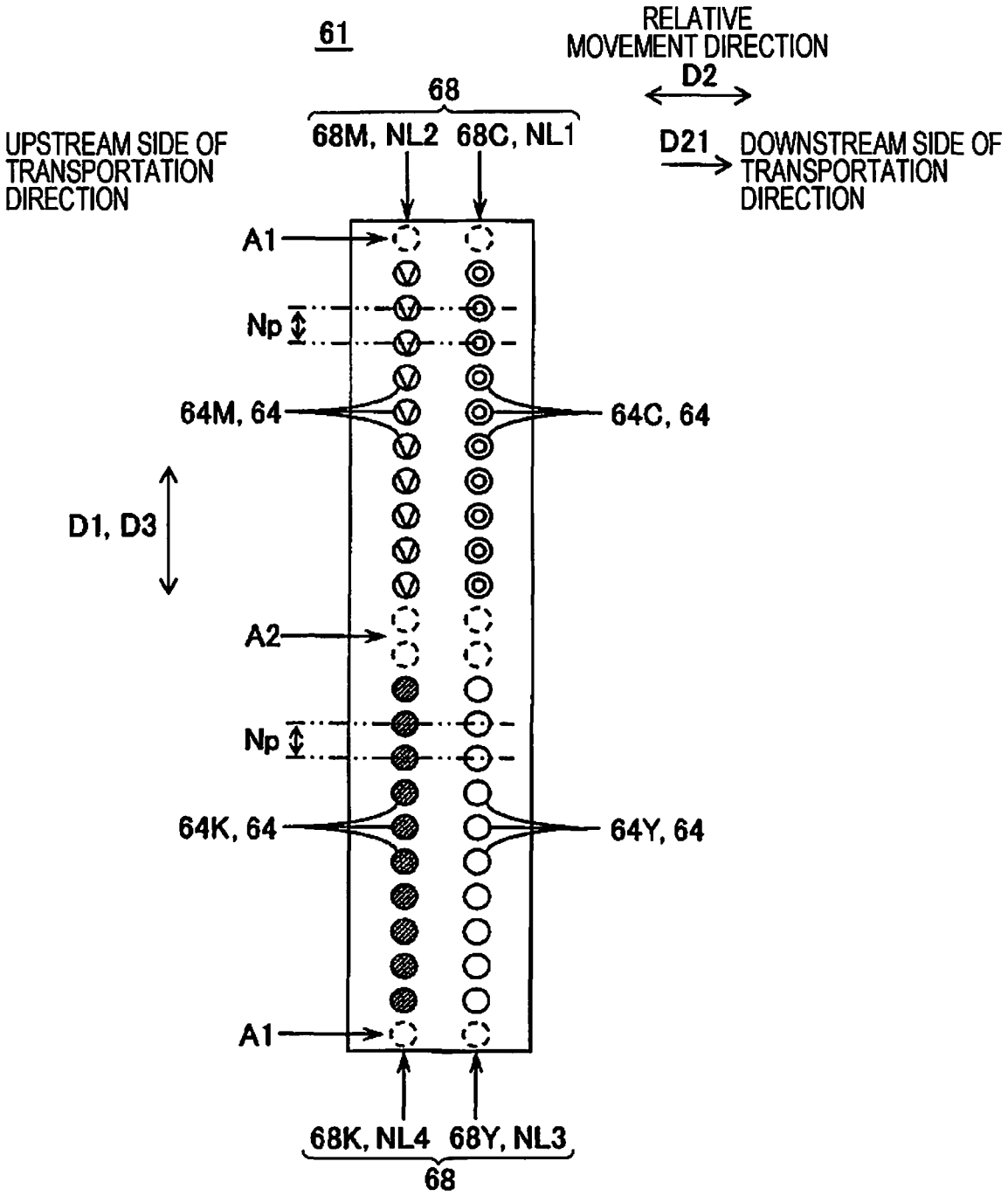
FIG. 3 is a diagram that schematically illustrates an example of a head chip.

FIG. 2 schematically illustrates essential components of the line printer as the ink jet printer 2. FIG. 3 schematically illustrates one head chip 61. In FIGS. 2 and 3, the recording head 60 is illustrated when viewed from the side that is opposite to the nozzle surface of the nozzle 64. However, for convenience, the position of the nozzle 64 is indicated, and a nozzle from which an ink droplet 67 of C, M, Y, or K is discharged is marked with the color of the ink droplet 67.

The line printer has a line head that is the recording head 60 that results from combining a plurality of head chips 61. When the ink droplet 67 is discharged and thus a dot DT0 is formed, the long-sized print substrate ME1 moves without the recording head 60 moving. The print substrate is a matter that retains a printing image. The print substrates include all varieties of paper or paperboard and all processed products that are specified in Japanese Industrial Standards (JIS) P0001:1998 (paper or paperboard and pulp terms). The print substrates include a resin sheet, a metal plate, a three-dimensional object and the like as well.

In FIG. 2, reference characters D1 indicate a side-by-side arrangement direction of the nozzle 64, reference characters D2 indicate a direction of relative movement between the recording head 60 and the print substrate ME1, reference characters D21 indicate a paper feeding direction, and reference characters D3 indicate a width direction of long-sized print substrate ME1. The relative movement direction D2 is also referred to as a scanning direction. When the print substrate ME1 moves from the transportation direction upstream side to the transportation direction downstream side with respect to the fixed recording head 60, a dot DT0 is formed on the print substrate ME1, starting from the transportation direction upstream side to the transportation direction downstream side. In an example in FIG. 2, the side-by-side arrangement direction D1 is consistent with a width direction D3, but the side-by-side arrangement direction D1 may deviate by approximately 45° with respect to the width direction D3, and so forth. The directions D1 and D3 and the paper feeding direction D21 (the relative movement direction D2) may be different directions. Not only a case where the directions D1 and D3 and the paper feeding direction D21 are orthogonal to each other, but also a case where the directions D1 and D3 and the paper feeding direction D21 intersect each other without being orthogonal to each other, such as when the directions D1 and D3 and the paper feeding direction D21 intersect each other by approximately 45° is included in the invention. Of course, the intersection of two directions includes the two directions being orthogonal to each other and means that the two directions deviate with respect to each other. The recording head 60 or the dot DT0 that is illustrated in FIGS. 2 and 3 and other figures is schematically illustrated for the purpose of description only. An actual size or a shape of the recording head 60 or the dot DT0, or the number of the recording heads 60 or the dots DT0 is not limited to that as illustrated in these figures. For example, the head chips 61 that are included in the recording head 60 is not limited in number to six head chips 61 that are illustrated in FIG. 2. The number of the head chips 61 may be equal to or smaller than 5, or is equal to 7 or greater than 7. The number of the nozzle rows 68 that are included in the head chip 61 is not limited to 4, and may be equal to or smaller than 3, or is equal to or greater than 5. The number of the nozzles that are included in the nozzle row 68 is not limited to 10 and is normally equal to or greater than 11, but may be equal to or smaller than 9.

The recording head 60 that is illustrated in FIG. 2 includes a plurality of head chips 61, each of which has the nozzle row 68C for C (an example of the first nozzle row NL1), the nozzle row 68M for M (an example of the second nozzle row NL2), the nozzle row 68Y for Y (an example of the third nozzle row NL3), and the nozzle row 68K for K (an example of the fourth nozzle row NL4). Here, the nozzle rows 68C and 68M are arranged side by side in the relative movement direction D2, the nozzle rows 68Y and 68K are arranged side by side in the relative movement direction D2, the nozzle rows 68C and 68Y are arranged side by side in the side-by-side arrangement direction D1, and the nozzle rows 68M and 68K are arranged side by side in the side-by-side arrangement direction D1. The nozzle row 68C here is an example of the first nozzle row NL1, the nozzle row 68M is an example of the second nozzle row NL2, the nozzle row 68Y is an example of the third nozzle row NL3, and the nozzle row 68K is an example of the fourth nozzle row NL4. In the recording head 60, a plurality of head chips, head chips 61*a*, 61*b*, 61*c*, 61*a*, 61*b*, and 61*c* are arranged in such a manner that the dot DT0 can be formed on the print substrate ME1 with the ink droplets 67 that are discharged from the nozzles 64C, 64M, 64Y, and 64K, over the entire width direction D3 of the print substrate ME1. Here, the head chips 61*a* to 61*c* are collectively referred to the head chip 61, the nozzle rows 68C, 68M, 68Y, and 68K are collectively referred to the nozzle row 68, and the nozzles 64C, 64M, 64Y, and 64K are collectively referred to the nozzle 64.

Moreover, although a nozzle row in which nozzles are arranged in a zigzag pattern is present, if a plurality of nozzles are arranged side by side in a predetermined side-by-side arrangement direction that is different from the relative movement direction, for example, in two rows, this arrangement is included in the present technology. The side-by-side arrangement direction in this case means a direction in which nozzles in each row are arranged side by side in the zigzag pattern arrangement.

As illustrated in FIG. 3, a plurality of nozzles 64 are arranged side by side at a gap, that is, a nozzle pitch Np in the side-by-side arrangement direction D1 in each nozzle row 68. In order to realize the high resolution of the printing image, the nozzle pitch Np need to be considerably small, and on the other hand, a channel for the ink up to the nozzle 64 needs to be formed in the head chip 61. For this reason, the nozzle 64 is not easy to form at the gap, that is, the nozzle pitch Np in both end portions of the head chip 61 in the side-by-side arrangement direction D1. In a case where the nozzle 64 cannot be formed at the gap, that is, the nozzle pitch Np in the both end portions of the head chip 61, the non-discharge area A1 occurs on both the end portion of the head chip 61. Furthermore, because the channel for the ink for each color needs to be formed in the side-by-side arrangement direction D1, it is not easy to form the nozzle 64 at the gap, that is, the nozzle pitch Np between the nozzle rows 68C and 68M and the nozzle rows 68Y and 68K. In a case where the nozzle 64 at the gap, that is, the nozzle pitch Np cannot be formed between the nozzle rows 68C and 68M and the nozzle rows 68Y and 68K, the non-discharge area A2 occurs between the nozzle rows 68C and 68M and the nozzle rows 68Y and 68K.

In a case where the non-discharge areas A1 and A2 where the nozzles are not present in the side-by-side arrangement direction D1 occur in the head chip 61, as illustrated in FIG. 2, in order to arrange the nozzles 64 for CMYK on the same line DL, a minimum of three head chips 61 need to be arranged side by side in the relative movement direction D2. In a specific example, the length La of the recording head 60 in the relative movement direction D2 is three times the length Lb of the head chip 61 in the relative movement direction D2. Accordingly, the length La of the recording head 60 in the relative movement direction D2 is shortened, it is difficult for the irregularity to occur in the landing position of the ink droplet 67, and it is difficult for the print substrate ME1 to further come into contact with the head chip 61.

In FIG. 2, it is illustrated that the line DL of the DT0 along the relative movement direction D2 is formed on the print substrate ME1 with the ink droplet 67 from the recording head 60. As will be described below, in the present specific example, the color irregularity between the printing areas due to the presence of a plurality of distance regarding the distance between the nozzle rows for different colors in the relative movement direction D2 is suppressed with setting of an amount-of-ink upper limit of a secondary color. The amount-of-ink upper limit is an upper limit of an amount of ink that is dischargeable per unit area of the print substrate ME1.

First, a configuration of the printing apparatus 1 that is illustrated in FIG. 1 will be described. The ink jet printer 2 that is illustrated in FIG. 1 includes a controller 10, a random access memory (RAM) 20, a non-volatile memory 30, a mechanism section 50, interfaces (I/Fs) 71 and 72, an operation panel 73, the temperature sensor SE1 that measures the temperature T, the humidity sensor SE2 that measures the humidity H, and the like. The controller 10, the RAM 20, the non-volatile memory 30, and the I/Fs 71 and 72, and the operation panel 73 is possibly set to input and output information. The temperature sensor SE1 and the humidity sensor SE2 are connected to the controller 10.

The controller 10 includes a central processing unit (CPU) 11, a resolution conversion section 41, a color conversion section 42, a halftone processing section 43, a signal transmission section 44, and the like. Moreover, among functions of these processing sections (41 to 44), the host apparatus 100 may be caused to realize at least one or several functions. The controller 10 can be configured with a system on a chip (SoC) or the like.

The CPU 11 is a device that primarily performs information processing or control in the ink jet printer 2.

The resolution conversion section 41 converts resolution of an image that is obtained from the host apparatus 100, a memory card 90, or the like into resolution (for example, 720×720 dpi or 360×360 dpi) for printing. The obtained image described above is expressed with RGB data that has an integer value of a 256 gradation for RGB (red, green, and blue) in each pixel. In a case where the obtained image is not the RGB data, the obtained image may be converted into the RGB data. The color conversion section 42, for example, converts input color data DA1 that is the RGB data which is set for the resolution for printing into output color data DA2 that is CMYK data which have an integer value of a 256 gradation for CMYK (cyanogen, magenta, yellow, and black) in each pixel. At that time, the color conversion section 42 converts the input color data DA1 into the output color data DA2 referring to a color conversion look-up table that is selected from among the color conversion look-up table LUT1, LUT2, and so forth. The color conversion look-up table LUT1 is referred to simply as "LUT1" and the color conversion look-up table LUT2 is simply referred to as "LUT2".

The halftone processing section 43 performs predetermined halftone processing, for example, such as a dither method, an error diffusion method, or a density pattern method, on a gradation value of each pixel that makes up the output color data DA2, reduces a gradation number of the gradation value, and generates recording data DA3. The recording data DA3 is data indicating a formation situation of a dot for each pixel that corresponds to a printing image IM1, and for example, can be set to be two-valued data indicating whether or not the dot for each pixel is formed. Furthermore, the recording data DA3 may be multi-valued data that has three or more gradations which possibly correspond to different-sized dots, such as four-valued data in which 0 is caused to correspond to the absence of a dot, 1 is caused to correspond to the formation of a small dot, 2 is caused to correspond to the formation of a middle dot, and 3 is caused to correspond to the formation of a large dot.

The signal transmission section 44 generates a drive signal SG that corresponds to a voltage signal which is applied to a drive element 63 of the head chip 61, based on the recording data DA3, and generates the generated drive signal SG to a drive circuit 62. Pieces of recording data DA3 may be rearranged side by side in the order in which dots are formed in the mechanism section 50, whenever necessary.

Each of the sections 41 to 44 described above may be configured with an application-specific integrated circuit (ASIC), and may read processing-target data directly from the RAM 20 or may write post-processing data directly to the RAM 20.

The mechanism section 50 that is controlled by the controller 10 includes a paper feeding mechanism 53 and the like. The paper feeding mechanism 53 transports the print substrate ME1 to the paper feeding direction D21. The head chip 61 from which the ink droplet 67 for CMYK is discharged is mounted on the recording head 60. The head chip 61 includes the drive circuit 62, the drive element 63, and the like. The drive circuit 62 applies the voltage signal to the drive element 63 according to the drive signal SG that is input from the controller 10. A piezoelectric element that applies pressure to ink 66 within a pressure room that communicates with the nozzle 64, a drive element that thermally causes a bubble to occur in the pressure room and thus causes the ink droplet 67 to be discharged from the nozzle 64, or the like can be used as the drive element 63. The ink 66 is supplied from an ink cartridge 65 into the pressure room of the head chip 61. A combination of the ink cartridge 65 and the head chip 61, for example, is provided for each of cyanogen, magenta, yellow, and black (CMYK). The ink 66 within the pressure room is discharged by the drive element 63 as the ink droplet 67 from the nozzle 64 toward the print substrate ME1, and the dot DT0 of the ink droplet 67 is formed on the print substrate ME1, such as a printing paper sheet. The printing image IM1 is formed by a plurality of dots DT0 on the print substrate ME1.

A program PRG 2, which causes the printing apparatus 1 to realize a function of the selection printing section U1, the print substrate type selection section U2, or the like, and the like are stored in the RAM 20.

A program data PRG1 that is loaded on the RAM 20, the color conversion look-up tables LUT1, LUT2, and so forth are stored in the non-volatile memory 30. A read only memory (ROM), a flash memory, a magnetic recording medium such as a hard disk, or the like is used as the non-volatile memory 30. Moreover, the loading of the program data PRG1 means that the program data PRG1 is written, as the program PRG2 that is possibly interpreted in the CPU 11, to the RAM 20.

A card I/F 71 is a circuit that writes data to a memory card 90 and or reads data from the memory card 90.

The communication I/F 72 is connected to a communication I/F 172 of the host apparatus 100, and inputs information to the host apparatus 100. A display apparatus 174 and the like may be connected to the host apparatus 100. Host apparatuses 100 include computers, such as personal computers (which include a tablet-type terminal), a digital camera, a digital video camera, a mobile telephone, such as a smartphone, and the like.

The operation panel 73 has an output section 74, an input section 75, and the like. Various instructions the ink jet printer 2 are possibly input through the operation panel 73. The output section 74, for example, is configured with a liquid crystal panel (a display section) on which information in accordance with various instructions or information indicating a state of the ink jet printer 2 is displayed. The output section 74 may output these pieces of information, as audio. The input section 75, for example, is configured with operation keys (an operation input section), such as a cursor key and a determination key. The input section 75 that may be a touch panel or the like that recognizes an operation on a display screen, as input.

Moreover, the mechanism section 50 that includes the paper feeding mechanism 53, and the head chip 61 are collectively referred to as a printing section UR.

Figure 4:
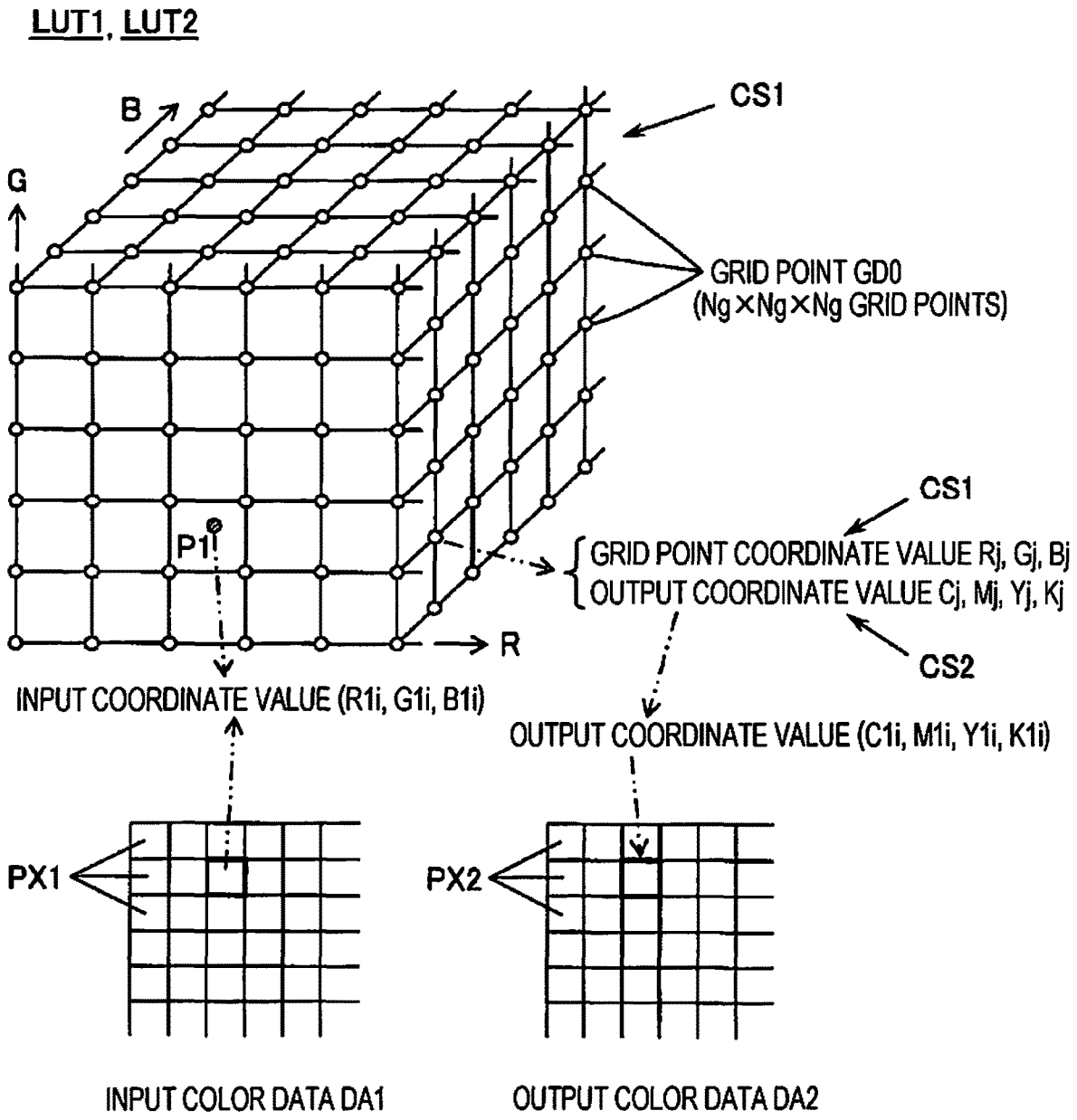
FIG. 4 is a diagram that schematically illustrates an example of a structure of a color conversion look-up table.

Next, an example of a structure of the color conversion look-up table will be described with reference to FIG. 4. Because LUT1 and LUT2 are similar in structure to each other, structures of LUT1 and LUT2 are collectively illustrated in a schematic manner in FIG. 4. In LUT1 and LUT2, a correspondence relationship between a coordinate value (Rj, Gj, Bj) in a RGB color space (an example of an input color space CS1) of the grid point GD0 in question concerning a plurality of grid points GD0, and a coordinate value (Cj, Mj, Yj, Kj) of a CMYK color space (an example of an output color space CS2) are stipulated. The variable j here is a coefficient that identifies the grid point GD0. Moreover, it is assumed that the grid point means a virtual point that is positioned in the input color space, and that an output coordinate value which corresponds to a position of a grid point in the input color space is stored in the grid point in question. Not only equal arrangement of a plurality of grid points within the input color space, but also unequal arrangement of the plurality of grid points within the input color space is included in the present technology. Each of LUT1 and LUT2 that are illustrated in FIG. 4 has Ng (Ng is an integer that is equal to or greater than 2) grid points GD0 with respect to an R axis, a G axis, and a B axis. The number Ng of grid points in an axis direction is not particularly limited, and can be set to 16, 32, 64, and so forth.

Here, a coordinate value of each pixel PX1 in the input color data DA1 is set to (R1*i*, G1*i*, B1*i*), a coordinate value of each pixel PX2 in the output color data DA2 is set to (C1*i*, M1*i*, Y1*i*, K1*i*). The variable j here is a variable that identifies the pixels PX1 and PX2. Each pixel PX1 in the input color data DA1 and each pixel PX2 in the output color data DA2 correspond to each other on a one-to-one basis. In FIG. 4, a point P1 in the RGB color space that corresponds to an input coordinate value (R1*i*, G1*i*, B1*i*) is schematically illustrated. The input coordinate value (R1*i*, G1*i*, B1*i*), for example, is converted into an output coordinate value (C1*i*, M1*i*, Y1*i*, K1*i*) based on a grid point coordinate value (Rj, Gj, Bj) of a plurality of grid points GD0 that surround the point P1, and the output coordinate value (Cj, Mj, Yj, Kj). For this conversion computation, a known interpolation method, such as tetrahedral interpolation or hexahedral interpolation, can be used.

Incidentally, in a case where the recording head 60 that includes a plurality of head chips 61 each of which has the non-discharge areas A1 and A2 is used, due to a combination of the nozzle rows 68C, 68M, 68Y, and 68K, there are times when the distance between the nozzle rows in the relative movement direction D2 varies according to the printing area.

As illustrated in FIG. 2, the distance L0 between the nozzle rows 68C and 68M in the relative movement direction D2 is fixed. On the other hand, a plurality of distances, distances L1 and L2 are present regarding a distance between the nozzle rows 68C and 68Y in the relative movement direction D2, and a plurality of distances are present as well regarding a distance between the nozzle rows 68M and 68Y in the relative movement direction D2. For example, the distance between the nozzle rows 68C and 68Y in the lines DL1 and DL3 is L1, and the distance between the nozzle rows 68C and 68Y in the line DL2 is L2 (L2>L1). Furthermore, the distance between the nozzle rows 68C and 68Y in the lines DL4 and DL6 is L1, but the order of discharging the ink droplet is the reverse of that in the case of the lines DL1 and DL3 in this. The distance between the nozzle rows 68C and 68Y in the line DL5 is L2, but the order of discharging the ink droplet is the reverse of that in the case of the line DL2. Moreover, the printing areas AL1, AL2, AL3, AL4, AL5, and AL6 are printing areas that have the same ink droplet discharge timing as the lines DL1, DL2, DL3, DL4, DL5, and DL6, respectively.

As illustrated in FIG. 11A, in a case where the distance between the nozzle rows is comparatively short, when a portion of the preceding ink droplet 67Y that is landed on the print substrate ME1 remains, as is, in the liquid state and the following ink droplet 67C in the liquid state overlaps the ink droplet 67Y in the liquid state, the ink droplets 67C and 67Y are mixed, as are, in the liquid state, a blurred dot is formed, and the coloring is weakened. On the other hand, as illustrated FIG. 11B, in a case where the distance between the nozzle rows is comparatively long, although the preceding ink droplet 67Y that is landed on the print substrate ME1 is dry and the following ink droplet 67C in the liquid state overlaps this portion, the ink droplets 67C and 67Y are not mixed, the dot that is formed is not blurred, and the coloring is strengthened when compared with the case where the distance between the nozzle rows is comparatively short. Therefore, when an amount-of-ink upper limit of a secondary color for C and Y or a secondary color for M and Y is set to be the same as an amount-of-ink upper limit of a secondary color for C and M, as is illustrated in FIG. 10, the streak or the color irregularity along the relative movement direction D2 occurs in the printing image.

Thus, as is the case with an amount-of-ink upper limit of LUT1 that is illustrated in FIG. 5, an amount-of-ink upper limit Dg of the secondary color for C and Y or an amount-of-ink upper limit Dr of the secondary color for M and Y is smaller than an amount-of-ink upper limit Db of the secondary color for C and M, and thus the streak or the color irregularity along the relative movement direction D2 can be suppressed from occurring in the printing image.

Here, "C+M" that is an ink color combination is expressed by the secondary color (which corresponds to blue (B)) for C and M, "C+Y" that is an ink color combination is expressed by the secondary color (which corresponds to green (G)) for C and Y, and "M+Y" that is an ink color combination is expressed by the secondary color (which corresponds to red (R)) for M and Y. An "inter-color distance" means a distance between nozzle rows that correspond to each color which is included in the ink color combination in the relative movement direction D2. The case of the ink color combination "C+M" means a distance L0 between the nozzle rows 68C and 68M. The case of the ink color combination "C+Y" means distances L1 and L2 between the nozzle rows 68C and 68Y. The case of the ink color combination "M+Y" means a distance between the nozzle rows 68M and 68Y. The amount-of-ink upper limit Db means an upper limit of a used amount of ink that results from combining a used amount of ink for C (which is equivalent to Cj) and a used amount Mj of ink for M, and is an upper limit of an amount of ink for a combination of the nozzle row 68C (the first nozzle row NL1) and the nozzle row 68M (the second nozzle row NL2). The amount-of-ink upper limit Dg means an upper limit of a used amount of ink that results from combining the used amount of ink for C (which is equivalent to Cj) and a used amount Yj of ink for Y, and is an upper limit of an amount of ink for a combination of the nozzle row 68C (the first nozzle row NL1) and the nozzle row 68Y (the third nozzle row NL3). The amount-of-ink upper limit Dr means an upper limit of a used amount of ink that results from combining the used amount Mj of ink for M (which is equivalent to Mj) and the used amount Yj of ink for Y, and is an upper limit of an amount of ink for a combination of the nozzle row 68M (the second nozzle row NL2) and the nozzle row 68Y (the third nozzle row NL3).

LUT1 is a color conversion look-up table in which the amount-of-ink upper limits Dg and Dr (120% in FIG. 5) of the secondary colors that are different in the "inter-color distance" from each other is smaller than the amount-of-ink upper limit Db (150% in FIG. 5) of the secondary color that is fixed in terms of "inter-color distance". LUT2 is a color conversion look-up table in which the amount-of-ink upper limits Dg and Dr (150% in FIG. 5) of the secondary colors that are different in the "inter-color distance" from each other is combined with the amount-of-ink upper limit Db (150% in FIG. 5) of the secondary color that is fixed in terms of "inter-color distance". In LUT1 and LUT2, the amount-of-ink upper limit Db is a maximum value of a sum of the used amount Cj of ink and the amount-of-ink upper limit Mj, the amount-of-ink upper limit Dg is a maximum value of a sum of the used amount Cj of ink and the amount-of-ink upper limit Yj, and the amount-of-ink upper limit Dr is a maximum value of a sum of the used amount Mj of ink and the amount-of-ink upper limit Yj. "MAX" is a function indicating a maximum value.

In a case where with the use of LUT1 described above, the ink droplet 67 is discharged from the nozzle row 68C and the nozzle row 68Y on the same line DL along the relative movement direction D2, the amount-of-ink upper limit Dg falls below the amount-of-ink upper limit Db of the secondary color for C and M. Accordingly, the difference in coloring due to the distance between the nozzle rows 68C and 68Y in the relative movement direction D2 is suppressed and the color irregularity is suppressed. Furthermore, even in a case where the ink droplet 67 is discharged from the nozzle row 68M and the nozzle row 68Y on the same line DL along the relative movement direction D2, the amount-of-ink upper limit Dr falls below the amount-of-ink upper limit Db of the secondary color for C and M. Accordingly, the difference in coloring due to the distance between the nozzle rows 68M and 68Y in the relative movement direction D2 is suppressed and the color irregularity is suppressed. On the other hand, in a case where the ink droplet 67 is discharged from the nozzle row 68C and the nozzle row 68M on the same line DL in the relative movement direction D2, because the distance L0 between the nozzle row 68C and the nozzle row 68M is fixed, although the amount-of-ink upper limit Db is maintained, the color irregularity does not occur. When the amount-of-ink upper limit Db is lowered to such an extent, the color reproduction range as a whole is narrowed, but the amount-of-ink upper limit Db for a combination of the nozzle rows 68C and 68M is maintained and thus the color reproducibility is secured.

As described above, in the present specific example, the color irregularity due to the presence of a plurality of distances regarding the distance between nozzle rows for different colors in the relative movement direction of the recording head is possibly suppressed.

3. Example in which the Color Conversion Look-Up Table is Selectively Used

However, the lowering of the amount-of-ink upper limit of a certain secondary color means narrowing of a color reproduction range of the certain secondary color. Thus, in a case where it is difficult for the color irregularity due to the difference in the "inter-color distance" to occur, the amount-of-ink upper limit may not be lowered. For example, as print substrates, there are a print substrate on which it is easy for the color irregularity due to the difference in "inter-color distance" to occur, and a print substrate on which it is difficult for the color irregularity due to the difference in the "inter-color distance" to occur. Thus, in a case where a type of the print substrate can be selected, the color conversion look-up table that is to be used may be changed according to the type of the print substrate.

FIG. 6 illustrates an example of print substrate type selection processing that is performed in the printing apparatus 1. In FIG. 6, a print substrate type election screen 500 is also illustrated. In a specific example, the ink jet printer 2 is described as performing the print substrate type selection processing, but although the host apparatus 100 may perform the print substrate type selection processing. The ink jet printer 2 and the host apparatus 100 may perform the print substrate type selection processing in cooperation with each other. The printing apparatus 1 is set to possibly perform a plurality of processing operation in a concurrent manner, with the use of multitasking. The print substrate type selection processing is set to start when the operation panel 73 or the host apparatus 100 is caused to perform a predetermined operation of setting a type of the print substrate. Here, the ink jet printer 2 that performs the print substrate type selection processing corresponds to the print substrate type selection section U2.

Moreover, the processing according to the present embodiment is not limited to an example of processing that is performed by the CPU, and may be performed by another electronic component (for example, application-specific integrated circuit (ASIC)). Furthermore, the processing according to the present embodiment may be processing that is distributed among a plurality of CPUs, and may be performed with the cooperation of the CPU and the electronic component (the ASIC).

When the processing is caused to start, the controller 10 of the ink jet printer 2 displays the print substrate type election screen 500 for selecting the type of the print substrate ME1 that is to be used for printing, on the output section 74 of the operation panel 73 (Step S102) (the use of the term "Step" is hereinafter omitted). A list of types of the available print substrates ME1 is displayed on the print substrate type election screen 500, and the type of the print substrate ME1 that is to be used for printing is selected from the list. For example, the type of the print substrate on which it is easy for the color irregularity due to the difference in the "inter-color distance" to occur is "Medium 1" (an example of a first type), and the type of the print substrate on which it is difficult for the color irregularity due to the difference in the "inter-color distance" to occur is "Medium 2" (an example of a second type). The controller 10 recognizes an operation of selecting one from among "Medium 1", "Medium 2", and so forth", as input, through the input section 75.

When the type of the print substrate ME1 is selected, the controller 10 stores the selected type of the print substrate ME1, for example, on the non-volatile memory 30 (S104), and causes the print substrate type selection processing to be ended. For example, when Medium 1 is selected, information indicating "Medium 1" is stored.

FIG. 7 illustrates an example of selection printing processing that uses the color conversion look-up table in accordance with the type of the print substrate ME1. The processing starts when an image is obtained from the host apparatus 100, the memory card 90, or the like. Here, the ink jet printer 2 that performs the selection printing processing corresponds to the selection printing section U1. Furthermore, S202 to S204, S206, and S210 to S212 illustrate processing that performs the first printing in which the amount-of-ink upper limits Dg and Dr are smaller than the amount-of-ink upper limit Db. S202 to S204, S208, and S210 to S212 illustrate processing that performs the second printing in which the amount-of-ink upper limits Dg and Dr are set to be the amount-of-ink upper limit Db.

When the selection printing processing is caused to start, the controller 10 causes the resolution conversion section 41 to convert resolution of the image that is obtained from the host apparatus 100 or the like into resolution for printing (S202). After the resolution is converted, the controller 10 causes the processing to branch, according to the type of the print substrate ME1 (S204).

In a case where "Medium 1" on which it is easy for the color irregularity due to the difference in the "inter-color distance" to occur is stored in the non-volatile memory 30, the controller 10 causes the color conversion section 42 to convert the input color data DA1 into the output color data DA2, referring to LUT1 (S206). LUT1 is the color conversion look-up table for converting the input coordinate value (R1*i*, G1*i*, B1*i*) into the output coordinate value (C1*i*, M1*i*, Y1*i*, K1*i*) in such a manner that the amount-of-ink upper limits Dg and Dg are smaller than the amount-of-ink upper limit Db. Therefore, according to LUT1, the input color is converted into the output color in which ink is used in such a manner that the amount-of-ink upper limits Dg and Dr is smaller than the amount-of-ink upper limit Db.

In a case where "Medium 2" on which it is difficult for the color irregularity due to the difference in the "inter-color distance" to occur is stored in the non-volatile memory 30, the controller 10 causes the color conversion section 42 to convert the input color data DA1 into the output color data DA2, referring to LUT2 (S208). LUT2 is a color conversion look-up table for converting the input coordinate value (R1*i*, G1*i*, B1*i*) into the output coordinate value (C1*i*, M1*i*, Y1*i*, K1*i*) in such a manner that the amount-of-ink upper limits Dg and Dg are the amount-of-ink upper limit Db. Therefore, according to LUT2, the input color is converted into the output color in which ink is used in such a manner that the amount-of-ink upper limits Dg and Dr is the amount-of-ink upper limit Db.

More, a type (which is defined as "Medium 3") of the print substrate that is different from "Medium 1" and "Medium 2" is selected, the controller 10 may convert the input color data DA1 into the output color data DA2, referring to a color conversion look-up table that is different from LUT1 and LUT2.

After the output color data DA2 is generated, the controller 10 causes the halftone processing section 43 to perform a predetermined halftone processing on the output color data DA2, and thus reduces a gradation number of a gradation value and generates the recording data DA3 (S210). After the recording data DA3 is generated, the controller 10 causes the signal transmission section 44 to generate the drive signal SG based on the recording data DA3 and to output the generated drive signal SG to the drive circuit 62. Furthermore, the controller 10 causes the mechanism section 50 to be driven (S212) and causes the selection printing processing to be ended.

As described above, in a case where the selected type of the print substrate ME1 is "Medium 1", the first printing in which the amount-of-ink upper limits Dg and Dr are smaller than the amount-of-ink upper limit Db is performed. Furthermore, in a case where the selected type of the print substrate ME1 is "Medium 2", the second printing in which the amount-of-ink upper limits Dg and Dr are set to be the amount-of-ink upper limit Db is performed. Therefore, in a case where the type of the print substrate ME1 is "Medium 2", because the amount-of-ink upper limits Dg and Dr are not lowered, the color reproducibility is improved. Of course, in a case where the type of the print substrate ME1 is "Medium 1", the color irregularity due to the difference in the "inter-color distance" is suppressed.

Furthermore, when an ambient temperature of the ink jet printer 2 rises, because it is easy for the landed ink droplet to dry, it is difficult for ink droplets of different colors to be mixed. On the other hand, when the ambient temperature of the ink jet printer 2 falls, because it is difficult for the landed ink droplet to dry, it is easy for ink droplets of different colors to be mixed in the liquid state and the dot coloring due to the ink droplet is weakened. Thus, for example, in a case where the ink jet printer 2 includes the temperature sensor SE1, the color conversion look-up table is changed according to a measurement temperature T of the temperature sensor SE1. Preferably, the temperature sensor SE1 is a temperature sensor that measures the ambient temperature, but may be a temperature sensor or the like that measures a temperature of the recording head 60.

FIG. 8 illustrates an example of the selection printing processing that uses the color conversion look-up table in accordance with a temperature condition. The processing also starts when the image is obtained from the host apparatus 100, the memory card 90, or the like. The ink jet printer 2, which performs the selection printing processing, also corresponds to the selection printing section U1. S302 to S306, S308, and S312 to S314 illustrate processing that performs the first printing in which the amount-of-ink upper limits Dg and Dr are smaller than the amount-of-ink upper limit Db. S302 to S306, S310, and S312 to S314 illustrate processing that performs the second printing in which the amount-of-ink upper limits Dg and Dr are set to be the amount-of-ink upper limit Db.

When the selection printing processing is caused to start, the controller 10 causes the resolution conversion section 41 to convert the resolution of the image that is obtained from the host apparatus 100 or the like into the resolution for printing (S302). Furthermore, the controller 10 acquires the temperature T that is measured by the temperature sensor SE1 (S304), and causes the processing to branch according to the temperature condition (S306). For example, if a threshold for the measurement temperature T is set to be a threshold Tt and the temperature T is lower than the threshold Tt, it can be determined that the first temperature condition is satisfied, and if the temperature T is equal to or higher than the threshold Tt, it can be determined that the second temperature condition, a temperature in which is higher than that in the first temperature condition is satisfied.

In a case where T<Tt where it is easy for the color irregularity due to the difference in the "inter-color distance" to occur, the controller 10 causes the color conversion section 42 to convert the input color data DA1 into the output color data DA2, referring to LUT1 (S308). On the other hand, in a case where T≥Tt where it is difficult for the color irregularity due to the difference in the "inter-color distance" to occur, the controller 10 causes the color conversion section 42 to convert the input color data DA1 into the output color data DA2, referring to LUT2 (S310).

Moreover, in a case where a temperature condition that is different from the first temperature condition and the second temperature condition is satisfied, the controller 10 may convert the input color data DA1 into the output color data DA2, referring to a color conversion look-up table that is different from LUT1 and LUT2.

After the output color data DA2 is generated, the controller 10 causes the halftone processing section 43 to convert the output color data DA2 into the recording data DA3 (S312). After the recording data DA3 is generated, the controller 10 causes the signal transmission section 44 to generate the drive signal SG based on the recording data DA3 and to output the generated drive signal SG to the drive circuit 62. Furthermore, the controller 10 causes the mechanism section 50 to be driven (S314) and causes the selection printing processing to be ended.

As described above, in the case of the first temperature condition in which it is easy for the color irregularity due to the difference in the "inter-color distance" to occur, the first printing in which the amount-of-ink upper limits Dg and Dr are smaller than the amount-of-ink upper limit Db. Furthermore, in the case of the second temperature condition in which it is difficult for the color irregularity due to the difference in the "inter-color distance" to occur, the second printing in which the amount-of-ink upper limits Dg and Dr are set to be the amount-of-ink upper limit Db. Therefore, in a case where the second temperature condition is satisfied, because the amount-of-ink upper limits Dg and Dr are not lowered, the color reproducibility is improved. Of course, in a case where the first temperature condition is satisfied, the color irregularity due to the difference in the "inter-color distance" is suppressed.

Moreover, in a case where "Medium 1" on which it is easy for the color irregularity due to the difference in the "inter-color distance" to occur is selected and in the case of the first temperature condition in which it is easy for the color irregularity due to the difference in the "inter-color distance" to occur, the first printing may be performed, and in cases other than these cases, the second printing may be performed. Furthermore, in the case where "Medium 1" on which it is easy for the color irregularity due to the difference in the "inter-color distance" to occur is selected, or in the case of the first temperature condition in which it is easy for the color irregularity due to the difference in the "inter-color distance" to occur, the first printing may be performed, and in cases other than these cases, the second printing may be performed.

Furthermore, when ambient humidity of the ink jet printer 2 falls, because it is easy for the landed ink droplet to dry, it is difficult for ink droplets of different colors to be mixed. On the other hand, when the ambient humidity of the ink jet printer 2 rises, because it is difficult for the landed ink droplet to dry, it is easy for ink droplets of different colors to be mixed in the liquid state and the dot coloring due to the ink droplet is weakened. Thus, for example, in a case where the ink jet printer 2 includes the humidity sensor SE2, the color conversion look-up table is changed according to measurement humidity H of the humidity sensor SE2. Preferably, the humidity sensor SE2 is a humidity sensor that measures the ambient humidity, but may be a humidity sensor or the like that measures humidity of the recording head 60.

FIG. 9 illustrates an example of the selection printing processing that uses the color conversion look-up table in accordance with the humidity condition. The processing also starts when the image is obtained from the host apparatus 100, the memory card 90, or the like. The ink jet printer 2, which performs the selection printing processing, also corresponds to the selection printing section U1. S402 to S406, S408, and S412 to S414 illustrate processing that performs the first printing in which the amount-of-ink upper limits Dg and Dr are smaller than the amount-of-ink upper limit Db. S402 to S406, S410, and S412 to S414 illustrate processing that performs the second printing in which the amount-of-ink upper limits Dg and Dr are set to be the amount-of-ink upper limit Db.

When the selection printing processing is caused to start, the controller 10 causes the resolution conversion section 41 to convert the resolution of the image that is obtained from the host apparatus 100 or the like into the resolution for printing (S402). Furthermore, the controller 10 acquires the humidity H that is measured by the humidity sensor SE2 (S404), and causes the processing to branch according to the humidity condition (S406). For example, if a threshold for the measurement humidity H is set to be a threshold Ht and the humidity H is higher than the threshold Ht, it can be determined that the first humidity condition is satisfied, and if the humidity H is equal to or higher than the humidity Ht, it can be determined that the second humidity condition, the humidity in which is higher than that in the first humidity condition is satisfied.

In a case where H≥Ht where it is difficult for the color irregularity due to the difference in the "inter-color distance" to occur, the controller 10 causes the color conversion section 42 to convert the input color data DA1 into the output color data DA2, referring to LUT1 (S408). On the other hand, in a case where H<Ht where it is difficult for the color irregularity due to the difference in the "inter-color distance" to occur, the controller 10 causes the color conversion section 42 to convert the input color data DA1 into the output color data DA2, referring to LUT2 (S410).

Moreover, in a case where a humidity condition that is different from the first humidity condition and the second humidity condition is satisfied, the controller 10 may convert the input color data DA1 into the output color data DA2, referring to a color conversion look-up table that is different from LUT1 and LUT2.

After the output color data DA2 is generated, the controller 10 causes the halftone processing section 43 to convert the output color data DA2 into the recording data DA3 (S412). After the recording data DA3 is generated, the controller 10 causes the signal transmission section 44 to generate the drive signal SG based on the recording data DA3 and to output the generated drive signal SG to the drive circuit 62. Furthermore, the controller 10 causes the mechanism section 50 to be driven (S414) and causes the selection printing processing to be ended.

As described above, in the case of the first humidity condition in which it is easy for the color irregularity due to the difference in the "inter-color distance" to occur, the first printing in which the amount-of-ink upper limits Dg and Dr are smaller than the amount-of-ink upper limit Db. Furthermore, in the case of the second humidity condition in which it is difficult for the color irregularity due to the difference in the "inter-color distance" to occur, the second printing in which the amount-of-ink upper limits Dg and Dr are set to be the amount-of-ink upper limit Db. Therefore, in a case where the second humidity condition is satisfied, because the amount-of-ink upper limits Dg and Dr are not lowered, the color reproducibility is improved. Of course, in a case where the first humidity condition is satisfied, the color irregularity due to the difference in the "inter-color distance" is suppressed.

Moreover, in a case where "Medium 1" on which it is easy for the color irregularity due to the difference in the "inter-color distance" to occur is selected and in the case of the first humidity condition in which it is easy for the color irregularity due to the difference in the "inter-color distance" to occur, the first printing may be performed, and in cases other than these cases, the second printing may be performed. Of course, in a case where "Medium 1" is selected, in the case of the first temperature condition, and in the case of the first humidity condition, the first printing may be performed, and in cases other than these cases, the second printing may be performed. Furthermore, in the case where "Medium 1" on which it is easy for the color irregularity due to the difference in the "inter-color distance" to occur is selected, or in the case of the first humidity condition in which it is easy for the color irregularity due to the difference in the "inter-color distance" to occur, the first printing may be performed, and in cases other than these cases, the second printing may be performed. Of course, in "Medium 1" is selected, in the case of the first temperature condition, or in the case of the first humidity condition, the first printing may be performed, and in cases other than these cases, the second printing may be performed.

4. Modification Example

Various modification examples of the invention are considered.

For example, the ink jet printer is not limited to the line printer, and may be a serial printer or the like that causes a recording head which results from combining a plurality of head chips to reciprocate in a main scanning direction different to a sub-scanning direction (the paper feeding direction).

Furthermore, the output device is not limited to the ink jet printer that forms a two-dimensional printing image, and may be a three-dimensional printer or the like. The ink includes not only liquid for expressing a color, but also various types of liquid that have any function, such as color-free ink that is given a feeling of gloss. Therefore, the ink droplets include various droplets such as a color-free droplet.

The input color space is not limited to the RGB color space, and may be a CMY color space, a CMYK color space, or the like.

The processing described above is possibly changed in a suitable manner, such as when the order of the processing is changed. For example, in the selection printing processing in FIG. 8, the processing in S304 that acquires the temperature T is possibly performed before the resolution conversion in S302. Furthermore, a printing apparatus that uses only LUT1 without using LUT2 is also included in the present technology.

Moreover, the first nozzle row, the second nozzle row, the third nozzle row, and the fourth nozzle row can flexibly find application. For example, the first nozzle row can find application as the nozzle row 68M, the second nozzle row as the nozzle row 68C, and the third nozzle row as the nozzle row 68Y. In this case, the nozzle row 68C that is the second nozzle row and the third nozzle row 68Y that is the second nozzle row are arranged side by side in the side-by-side arrangement direction D1, and thus a distance between the nozzle row 68M (the first nozzle row) and the nozzle row 68C (the second nozzle row) in the relative movement direction D2 is fixed and a plurality of distances are present regarding a distance between the nozzle row 68M (the first nozzle row) and the nozzle row 68Y (the third nozzle row) in the relative movement direction D2.

Of course, arrangement of the nozzle rows with respect to the head chip is not limited to the arrangement that is illustrated in FIG. 3. For example, the nozzle row for C and the nozzle row for Y may be arranged side by side in the relative movement direction D2, and the nozzle row for M and the nozzle row for Y may be arranged side by side in the relative movement direction D2. Furthermore, the nozzle row for C and the nozzle row for M may be arranged side by side in the side-by-side arrangement direction D1, and the nozzle row for M and the nozzle row for Y may be arranged side by side in the side-by-side arrangement direction D1.

5. Wrap-Up

As described above, according to various aspects of the invention, a technology or the like can be provided in which the color irregularity due to the presence of a plurality of distances is possibly suppressed regarding the distance between the nozzle rows for different colors in the relative movement direction of the recording head. Of course, with a technology that is made up of only constituent elements of an independent claim, the basic operation and effects described above can be obtained.

Furthermore, a configuration that results from mutual substitution or a combination change in each configuration which is disclosed in the examples described above, a configuration that results from mutual substitution or a combination change in each configuration which is disclosed in the known technologies and the examples described above, and the like are possibly also implemented. These configurations and the like are also included in the invention.

This application claims priority under 35 U.S.C. § 119 to Japanese Patent Application No. 2017-050916, filed Mar. 16, 2017. The entire disclosure of Japanese Patent Application No. 2017-050916 is hereby incorporated herein by reference.

What is claimed is:

1. A printing apparatus in which a recording head and a print substrate move relative to each other in a relative movement direction that is different from a side-by-side arrangement direction of nozzles in a nozzle row, wherein the recording head has two or more first nozzle rows from which an ink droplet of a first color is discharged, two or more second nozzle rows from which an ink droplet of a second color is discharged, and two or more third nozzle rows from which an ink droplet of a third color is discharged, wherein, in a plurality of nozzle rows from which an ink droplet is discharged on the same line along the relative movement direction, a distance between the first nozzle row and the second nozzle row in the relative movement direction is fixed, and a plurality of distances are present regarding a distance between the first nozzle row and the third nozzle row in the relative movement direction, and wherein, concerning an amount-of-ink upper limit that is an upper limit of an amount of ink that is dischargeable per unit area of the print substrate, first printing in which an amount-of-ink upper limit for a combination of the first nozzle row and the third nozzle row is smaller than an amount-of-ink upper limit for a combination of the first nozzle row and the second nozzle row is performed.

2. The printing apparatus according to claim 1, wherein the recording head includes a plurality of head chips, each of which has the first nozzle row, the second nozzle row, and the third nozzle row, and wherein in the head chip, the first nozzle row and the second nozzle row are arranged side by side in the relative movement direction, and one of the first nozzle row and the second nozzle row and the third nozzle row are arranged side by side in the side-by-side arrangement direction.

3. The printing apparatus according to claim 2, wherein in the head chip, the third nozzle row and a fourth nozzle row from which an ink droplet of a fourth color is discharged are arranged side by side in the relative movement direction.

4. The printing apparatus according to claim 2, wherein a length of the recording head in the relative movement direction is three times a length of the head chip in the relative movement direction.

5. The printing apparatus according to claim 1, wherein the first color, the second color, and the third color are selected from among cyanogen, magenta, and yellow.

6. The printing apparatus according to claim 1, further comprising:

a selection printing section that selectively performs a plurality of printing operations including the first printing and second printing in which the amount-of-ink upper limit for the combination of the first nozzle row and the third nozzle row is set to be the amount-of-ink upper limit for the combination of the first nozzle row and the second nozzle row.

7. The printing apparatus according to claim 6, further comprising:

a print substrate type selection section through which a type of the print substrate that is used for printing is selected, wherein the selection printing section performs the first printing in a case where the selected type of the print substrate is a first type, and performs the second printing in a case where the selected type of the print substrate is a second type.

8. The printing apparatus according to claim 6, further comprising:

a temperature sensor that measures a temperature, wherein the selection printing section performs the first printing in a case where the temperature that is measured in the temperature sensor satisfies a first temperature condition, and performs the second printing in a case where a second temperature condition, a temperature in which is higher than a temperature in the first temperature condition, is satisfied.

9. The printing apparatus according to claim 6, further comprising:

a humidity sensor that measures humidity, wherein the selection printing section performs the first printing in a case where the humidity that is measured in the humidity sensor satisfies a first humidity condition, and performs the second printing in a case where a second humidity condition, humidity in which is lower than humidity in the first humidity condition, is satisfied.

10. The printing apparatus according to claim 6, wherein the selection printing section converts an input color into an output color in which ink is used in such a manner that the amount-of-ink upper limit for the combination of the first nozzle row and the third nozzle row is smaller than the amount-of-ink upper limit for the combination of the first nozzle row and the second nozzle row, according to a first correspondence relationship, when performing the first printing, and wherein the selection printing section converts the input color into the output color in which ink is used in such a manner that the amount-of-ink upper limit for the combination of the first nozzle row and the third nozzle row is the amount-of-ink upper limit for the combination of the first nozzle row and the second nozzle row, according to a second correspondence relationship, when performing the second printing.

11. A printing method comprising:

moving a recording head and a print substrate relative to each other in a relative movement direction that is different from a side-by-side arrangement direction of nozzles in a nozzle row, the recording head including two or more first nozzle rows from which an ink droplet of a first color is discharged, two or more second nozzle rows from which an ink droplet of a second color is discharged, and two or more third nozzle rows from which an ink droplet of a third color is discharged;

in a plurality of nozzle rows from which an ink droplet is discharged on the same line along the relative movement direction, setting a distance between the first nozzle row and the second nozzle row in the relative movement direction to be fixed, with a plurality of distances being present regarding a distance between the first nozzle row and the third nozzle row in the relative movement direction; and concerning an amount-of-ink upper limit that is an upper limit of an amount of ink that is dischargeable per unit area of the print substrate, performing first printing in which an amount-of-ink upper limit for a combination of the first nozzle row and the third nozzle row is smaller than an amount-of-ink upper limit for a combination of the first nozzle row and the second nozzle row.

* * * * *